US008534814B2

(12) United States Patent
Yazawa

(10) Patent No.: US 8,534,814 B2
(45) Date of Patent: Sep. 17, 2013

(54) INK CARTRIDGE AND RECORDING APPARATUS

(75) Inventor: Hiroaki Yazawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 104 days.

(21) Appl. No.: 13/072,728

(22) Filed: Mar. 27, 2011

(65) Prior Publication Data

US 2011/0310197 A1 Dec. 22, 2011

(30) Foreign Application Priority Data

Jun. 17, 2010 (JP) ..... 2010-137810

(51) Int. Cl.
*B41J 2/175* (2006.01)

(52) U.S. Cl.
USPC ..... 347/86

(58) Field of Classification Search
None
See application file for complete search history.

(56) References Cited

U.S. PATENT DOCUMENTS

| | | | | |
|---|---|---|---|---|
| 6,767,075 | B1 | 7/2004 | Takada et al. | |
| 7,393,091 | B2 * | 7/2008 | Kumagai et al. | 347/86 |
| 2005/0052511 | A1 * | 3/2005 | Seino et al. | 347/86 |
| 2008/0239036 | A1 | 10/2008 | Hattori | |
| 2009/0141106 | A1 | 6/2009 | Takagi | |
| 2009/0251515 | A1 | 10/2009 | Zhou et al. | |
| 2010/0085404 | A1 * | 4/2010 | Akiyama | 347/86 |

FOREIGN PATENT DOCUMENTS

| | | | |
|---|---|---|---|
| EP | 0412459 | A2 | 2/1991 |
| EP | 1352748 | A1 | 10/2003 |
| EP | 1790480 | A1 | 5/2007 |
| EP | 1839873 | A1 | 10/2007 |
| EP | 2080620 | A1 * | 7/2009 |
| EP | 2233301 | A1 | 9/2010 |
| JP | 2005-288866 | A | 10/2005 |
| JP | 2006-116787 | A | 5/2006 |
| WO | 98/55320 | A1 | 12/1998 |

OTHER PUBLICATIONS

European Patent Office, partial European Search Report for European Patent Application No. 11160393.2 (counterpart to above-captioned patent application), dated Mar. 23, 2012.

European Patent Office, extended European Search Report for European Patent Application No. 11160393.2 (counterpart European patent application), dated Oct. 22, 2012.

* cited by examiner

*Primary Examiner* — Matthew Luu
*Assistant Examiner* — Michael Konczal
(74) *Attorney, Agent, or Firm* — Baker Botts L.L.P.

(57) ABSTRACT

There is provided an ink cartridge including a body, a particular interface and an engagement portion. The body has a front side at which an ink supply portion is located for supplying ink stored in an ink chamber to an exterior of the ink chamber, and a rear side located to face the front side. The particular interface is positioned substantially adjacent to the ink supply portion at the front side, wherein the particular interface is configured to be biased by a biasing member in a specific direction. The engagement portion is configured to be engaged with a locking section of a cartridge installation portion for retaining the body in an installed state.

9 Claims, 16 Drawing Sheets

INK CARTRIDGE AND RECORDING APPARATUS

CROSS REFERENCE TO RELATED APPLICATION

This application claims priority from Japanese Patent Application No. 2010-137810 filed Jun. 17, 2010. The entire content of the priority application is incorporated herein by reference.

TECHNICAL FIELD

The present invention relates to an ink cartridge loadable on an image forming device provided with a biasing member for biasing the ink cartridge in a predetermined direction opposite to an installation direction defined as a direction in which the ink cartridge moves during an installation process.

BACKGROUND

An image forming device that forms an inked image on a sheet is known. Such the image forming device includes a recording head having nozzles through each of which an ink droplet is selectively ejected onto the sheet. The ink droplets adhered on the sheet forms a desired image. The image forming device has a cartridge installation portion, and uses an ink cartridge storing therein an ink to be supplied into the recording head. The ink cartridge is installable in and removable from the cartridge installation portion.

When the ink cartridge is removed from the cartridge loading portion since the ink in the ink cartridge runs down, the ink in the ink cartridge or an ink in an ink needle drops on an inner perimeter of the cartridge installation portion. Then a new ink cartridge is installed in the cartridge installation portion. The ink is then adhered to an outer perimeter of the new ink cartridge that is installed in the cartridge installation portion. The cartridge installation portion has a locking mechanism for positioning the ink cartridge and for retaining the ink cartridge in an installed state in the cartridge installation portion. Further, a biasing member is provided to bias the ink cartridge, which has been installed in the cartridge installation portion and engaged with the locking mechanism, in a removal direction in which the ink cartridge is removed from the cartridge installation portion. For removing the ink cartridge from the cartridge installation portion, the locking mechanism is operated to release (unlock) the ink cartridge, such that the ink cartridge is moved toward an opening of the cartridge installation portion by a biasing force of the biasing member. Thus, the ink cartridge is easily removed from the cartridge installation portion.

Further, when the ink cartridge is released, the ink cartridge could move vigorously, and the ink cartridge may be thrown out of the cartridge installation portion through the opening of the cartridge installation portion. As a result, the ink cartridge is thrown away (popped up) from the cartridge installation portion and impacts on the floor, thereby imparting impact on the ink cartridge to splash the ink out of the ink cartridge. Further, when the ink cartridge impacts onto a floor, the ink cartridge may be damaged. In order to avoid such accidental pop-up, a pop-up restraint mechanism is proposed in Laid-out Japanese Patent Application Publication No. 2005-288866.

According to the disclosed pop-up restraint (locking) mechanism, a resiliently deformable hooking pawl is provided at a cartridge installation portion, and an ink cartridge is formed with an engagement recess to be engageable with the pawl to avoid the pop-up when the ink cartridge is released from the biasing force of the biasing member.

SUMMARY

When a user replaces the ink cartridge repeatedly, for example, due to mis-installation of the ink cartridge, the hooking pawl may be plastically deformed. Therefore, the resiliency of the pawl may be impaired, or the pawl may be broken. As a result, the ink cartridge cannot be prevented from being popped up from the cartridge installation portion. In this case, the cartridge installation portion including the pawl must be replaced by a new cartridge installation portion. Incidentally, the replacement is also required in case of breakdown or mechanical fatigue of the locking mechanism. Thus, the user has to buy a new image forming device due to decline in function of the pawl and the locking mechanism.

It is, therefore, an object of the present invention to provide an ink cartridge capable of easily retaining a fully installed state of an ink cartridge in a cartridge installation portion.

In order to attain the above and other objects, the present invention provides an ink cartridge including a body, a particular interface and an engagement portion. The body has a front side at which an ink supply portion is located for supplying ink stored in an ink chamber to an exterior of the ink chamber, and a rear side located to face the front side. The particular interface is positioned substantially adjacent to the ink supply portion at the front side, wherein the particular interface is configured to be biased by a biasing member in a specific direction. The engagement portion is configured to be engaged with a locking section of a cartridge installation portion for retaining the body in an installed state According to another aspect of the present invention, there is provided a recording apparatus including a cartridge installation portion and a pressing mechanism. In the cartridge installation portion, an ink cartridge is installable. The ink cartridge includes: a body having a front side at which an ink supply portion is located for supplying ink stored in an ink chamber to an exterior of the ink chamber, and a rear side located to face the front side, the body having an upper surface extending from the front side to the rear side; a particular interface positioned substantially adjacent to the ink supply portion at the front side, wherein the particular interface is configured to be biased by a biasing member in a specific direction; and an engagement portion configured to be engaged with a locking section of a cartridge installation portion for retaining the body in an installed state. The pressing mechanism is provided at an upper portion of the cartridge installation portion and includes a biasing member and a lever portion. The biasing member is configured to bias the lever portion, and the lever portion is configured to press the upper surface of the ink cartridge downward such that the engagement portion frictionally engages the locking section.

According to still another aspect of the present invention, there is provided an ink cartridge to be loaded on and unloaded from a cartridge loading portion provided with a biasing member that biases the ink cartridge loaded in the cartridge loading portion in an unloading direction opposite to a loading direction. The ink cartridge includes a cartridge body, an ink supply portion, a protrusion and a first holding portion. The cartridge body has a front wall which is a leading side in the loading direction and a rear wall which is a trailing side in the loading direction, the cartridge body defining therein an ink chamber in which an ink is accommodated. The ink supply portion is positioned at a lower portion of the front wall for supplying the ink in the ink chamber to an outside. The protrusion protrudes from the front wall in the loading direction and positioned lower than the ink supply portion, the protrusion having a tip end abuttable on the biasing member to be biased in the unloading direction. The first holding portion retains the cartridge body at a predetermined position against a biasing force of the biasing member.

DETAILED DESCRIPTION

An ink cartridge 30 according to a first embodiment of the present invention will be described with reference to FIGS. 1 through 8.

Figure 1:
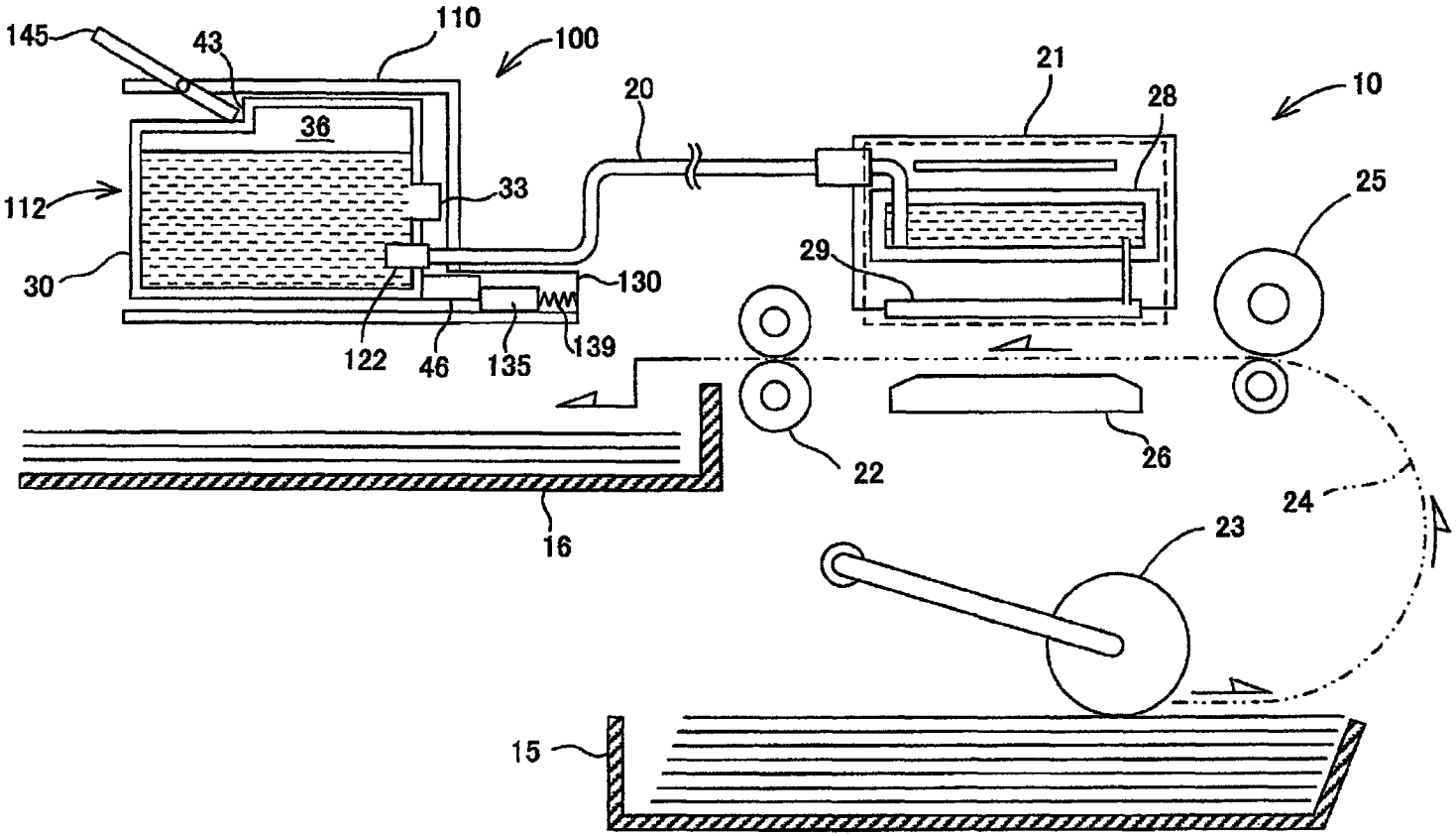
FIG. 1 is a schematic cross-sectional view schematically illustrating an internal structure of a printer, including an ink supply device, according to an embodiment of the present invention.

First, a printer 10 in which the ink cartridge 30 is accommodated will be described with reference to FIG. 1. The terms "upward", "downward", "upper", "lower", "above", "below", "beneath", "right", "left", "front", "rear" and the like will be used throughout the description assuming that the printer 10 is disposed in an orientation in which it is intended to be used.

The printer 10 is configured to form an image by ejecting ink droplets onto a sheet in accordance with an ink jet recording system. As shown in FIG. 1, the printer 10 includes an ink supply device 100 provided with a cartridge installation portion 110 in which the ink cartridge 30 detachably installable. The cartridge installation portion 110 has one side formed with an opening 112 exposed to an atmosphere. The ink cartridge 30 is detachably installable in the cartridge installation portion 110 through the opening 112. That is, the ink cartridge 30 can be inserted into the cartridge installation portion 110, and removed therefrom through the opening 112. The opening 112 is normally covered by a cover member (not shown) provided at a frame of the printer 10. The cover is opened for installation of the ink cartridge 30.

The ink cartridge 30 stores therein an ink to be used in the printer 10. The printer 10 includes a recording head 21 connected to the ink cartridge 30 via an ink tube 20 when the ink cartridge 30 is installed in the cartridge installation portion 110. The recording head 21 has a sub tank 28 in which the ink supplied through the ink tube 20 is temporarily stored. The recording head 21 also includes a plurality of nozzles 29 through which ink supplied from the sub tank 28 is selectively ejected in accordance with a recording image.

The printer 10 also includes a sheet supply tray 15, a sheet supply roller 23, a sheet passage 24, a pair of transfer rollers 25, a platen 26, a pair of discharge rollers 22, and a discharge tray 16 arranged in this order in a sheet feeding direction. The sheet supplied from the sheet supply tray 15 to the sheet passage 24 by the sheet supply roller 23 is conveyed to the platen 26 by the pair of transfer rollers 25. Then, the ink is selectively ejected from the recording head 21 onto the sheet passing through the platen 26 to form an image on the sheet. The sheet is then discharged onto the discharge tray 16 by the pair of discharge rollers 22.

Figure 2:
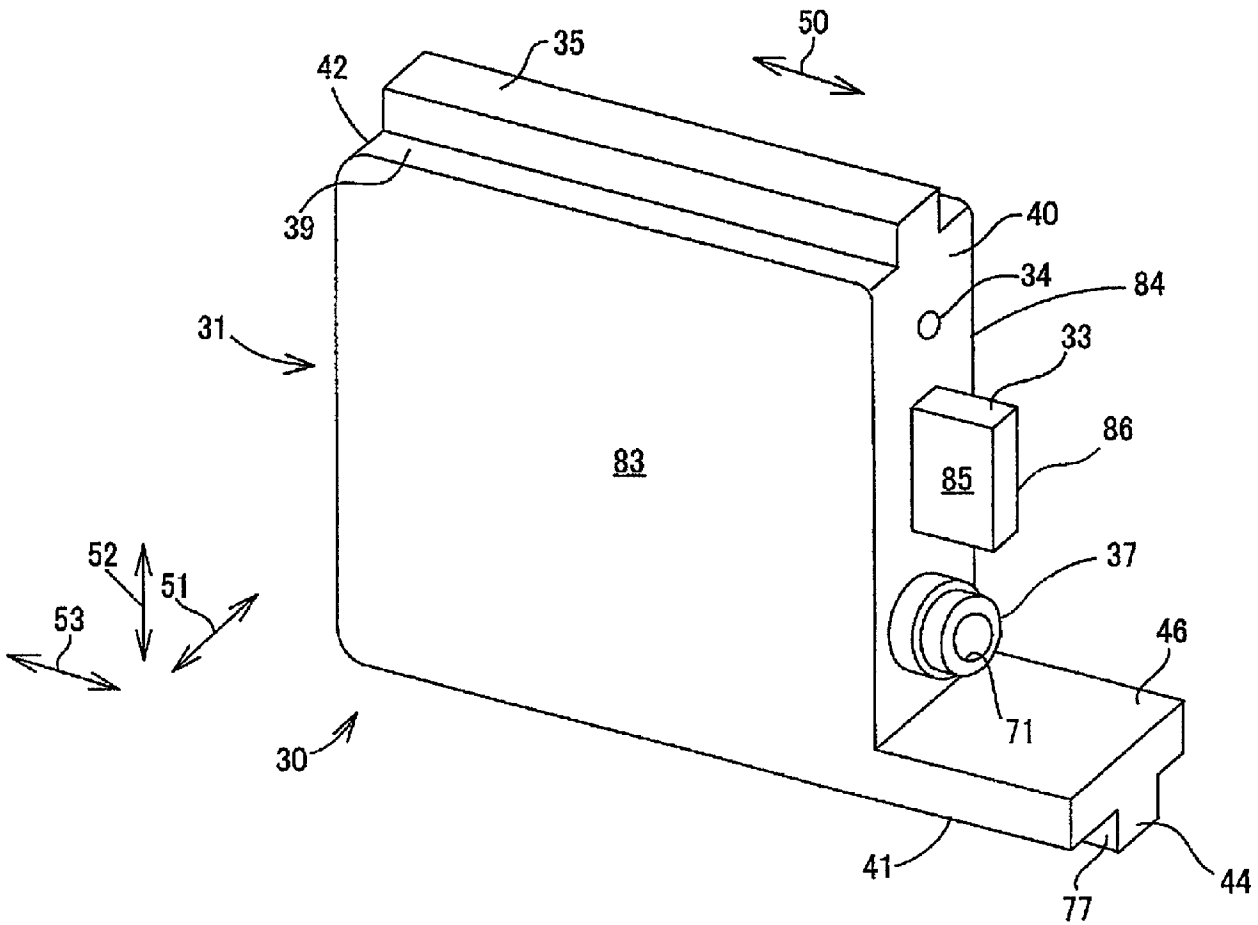
FIG. 2 is a perspective view illustrating an external configuration of an ink cartridge according to a first embodiment of the invention.
Figure 3:
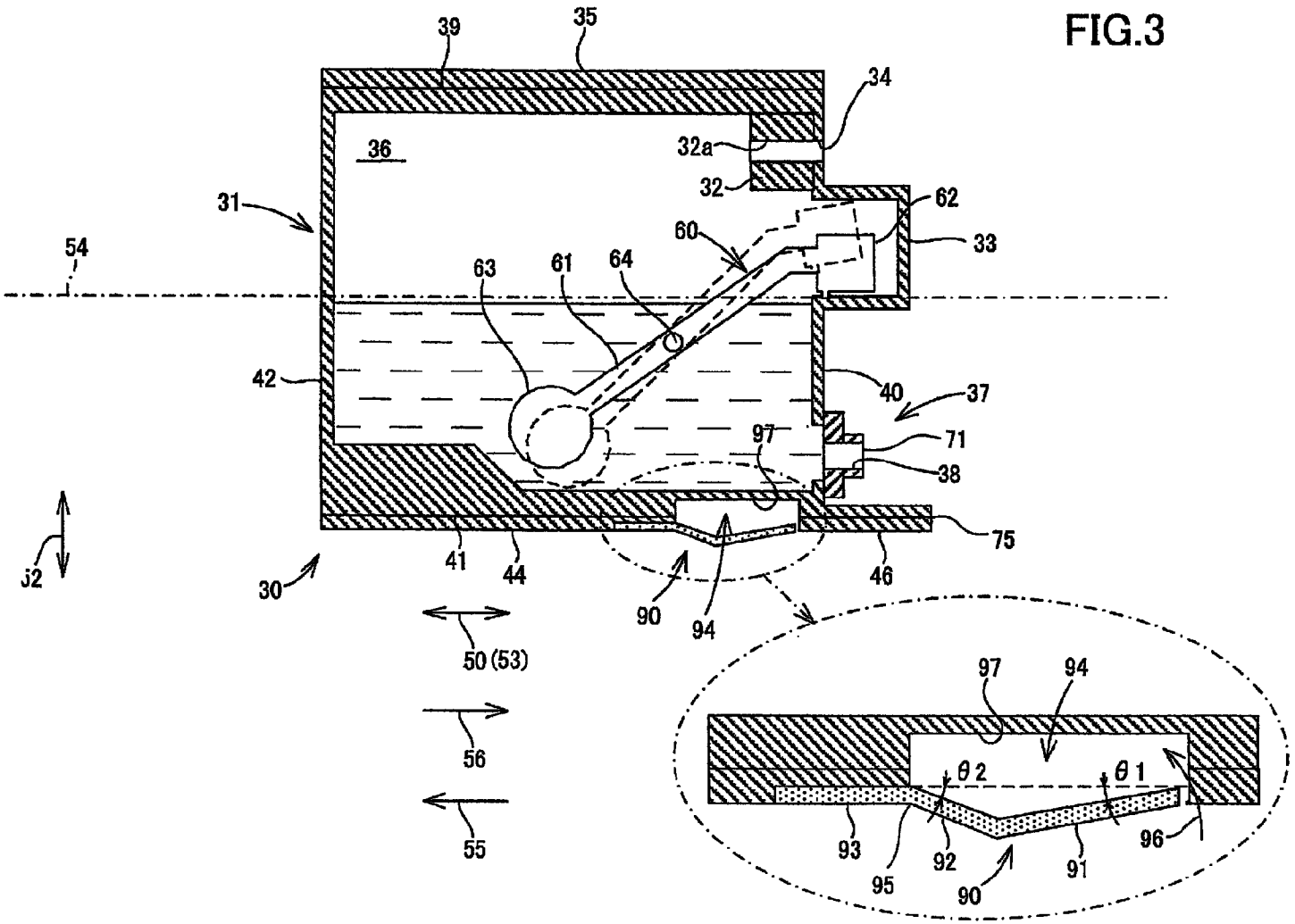
FIG. 3 is a vertical cross-sectional view illustrating an internal configuration of the ink cartridge according to the first embodiment of the invention.

Next, the ink cartridge 30 will be described. As shown in FIGS. 2 and 3, the ink cartridge 30 defines therein an ink chamber 36 in which the ink is stored. The ink cartridge 30 has e.g., a cartridge body 31 defining an outer perimeter of the ink cartridge 30. The ink chamber 36 may be defined inside the cartridge body 31, or may be defined by a member separate from the cartridge body 31 but inside the cartridge body 31.

The cartridge body 31 has a generally flat rectangular shape having small width (in a direction indicated by an arrow 51 which will be referred to as a widthwise direction or a horizontal direction), height (in a direction indicated by an arrow 52 which will be referred to as a vertical direction that is perpendicular to the widthwise direction) and depth (in a direction indicated by an arrow 53 which will be referred to as a depthwise direction that is perpendicular to the vertical direction and the widthwise direction) those greater than the width.

The ink cartridge 30 is installed in or removed from the cartridge installation portion 110 with respect to two directions 50 indicated by a two-way arrow 50 shown in FIG. 2 which are parallel to the depthwise direction 53. More specifically, as show in FIG. 3, the ink cartridge 30 is installed in the cartridge installation portion 110 in an insertion direction 56 and removed from the cartridge installation portion 110 in a removal direction 55 while retaining an upstanding state shown in FIGS. 2 and 3.

The cartridge body 31 has a front wall 40, a rear wall 42, a pair of side walls 83, 84, a top wall 39, and a bottom wall 41. The front wall 40 and the rear wall 42 are located on a leading side and on a trailing side, respectively, when installing the ink cartridge 30 into the cartridge installation portion 110, and are spaced away from each other in the depthwise direction 53. The pair of side walls 83, 84 extends in the depthwise direction 53 and are connected to the front wall 40 and the rear wall 42. The top wall 39 extends in the depthwise direction 53 for connecting upper ends of the front wall 40, rear wall 42, and the pair of side walls 83, 84. The bottom wall 41 extends in the depthwise direction 53 for connecting lower ends of the front wall 40, rear wall 42, and the pair of side walls 83, 84.

A detection portion 33 protrudes frontward (in the depthwise direction 53) from the front wall 40 at an approximately intermediate position in the vertical direction 52. Further, a protrusion 46 also protrudes frontward from a lower end portion of the front wall 40. The protrusion 46 protrudes farther forward than the detection portion 33 in the depthwise direction 53. That is, the detecting portion 33 has a protruding length smaller than that of the protrusion 46. The detection portion 33 has a box shape with an opening for allowing the detection portion 33 to be in fluid communication with an interior of the ink chamber 36. Further, the detection portion 33 has a pair of side walls (left and right walls) made from a translucent resin material and connected to the front wall 40. The side walls allow light emitted from an optical sensor 114 (FIG. 4) to pass therethrough. Each side wall extends in the vertical direction 52 or can be slanted relative to the vertical direction 52. The optical sensor 114 is provided at the cartridge installation portion 110.

As shown in FIG. 3, the detection portion 33 provides therein a hollow box space. A sensor arm 60 is movably provided in the ink chamber 36. The sensor arm 60 includes an arm body 61 and a shaft 64. The arm body 61 is plate shaped, and is pivotally movably supported to the shaft 64. The shaft 64 extends in the widthwise direction 51 and supported by a wall (not shown) extending from the interior of the ink cartridge 30. The arm body 61 includes an indicator 62 and a float 63, respectively positioned at opposite ends of the arm body 61. The indicator 62 is movably positioned in the hollow box space of the detection portion 33, i.e., between the pair of left and right walls of the detection portion 33 in the widthwise direction 51. With this structure, the sensor arm 60 is adapted to shift its pivoting posture in accordance with an amount of the ink in the ink chamber 36 between a lower position as shown by a solid line in FIG. 3 in which the indicator 62 approaches a lower wall of the detection portion 33 and an upper position as shown by a broken line in FIG. 3 in which the indicator 62 approaches an upper wall of the detection portion 33.

In the installed state of the ink cartridge 30 into the cartridge installation portion 110, the detection portion 33 is changeable between a light-transmissive state and a non-light-transmissive state. In the light-transmissive state, not less than a predetermined amount of infrared light can be transmitted through the detection portion 33, and in the non-light-transmissive state, less than the predetermined amount of infrared light is transmitted therethrough (the light is blocked, deflected or attenuated, or the light may be shut off, attenuated by a prism or reflected by a mirror to alter a path of the light). More specifically, the light-transmissive state and non-light-transmissive state are provided when the indicator 62 is at its upper position and lower position, respectively. In accordance with the light transmission state at the detection portion 33, whether the amount of ink in the ink chamber 36 is less than a predetermined amount of ink can be detected.

Figure 5:
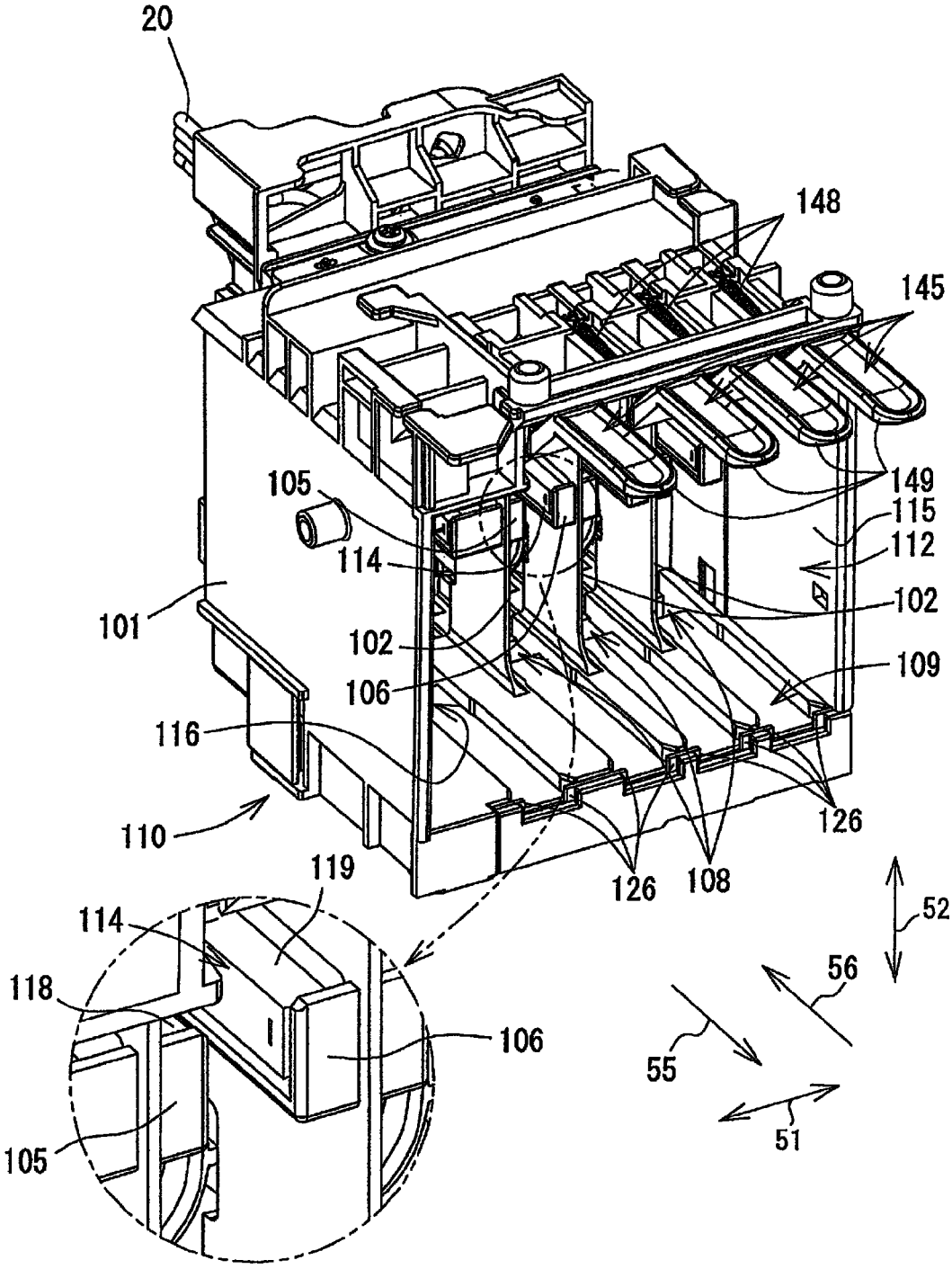
FIG. 5 is a perspective view illustrating an external configuration of the cartridge installation portion according to the first embodiment.

As described later, the optical sensor 114 includes a light emitting element 118 and a light receiving element 119 in opposition to each other in the widthwise direction 51 (FIG. 5). Light emitted from the light-emitting element 118 is received by the light receiving element 119. The sensor arm 60 may not be provided within the detection portion 33. The interior of the detection portion 33 is in fluid communication with the interior of the ink chamber 36 as described above. Therefore, infrared light emitted from the light emitting element 118 will be blocked, deflected or attenuated if ink is in the detection portion 33, while the infrared light will be transmitted through the detection portion 33 if ink is absent or insufficient in the detection portion 33. Alternatively, the infrared light emitted from the light emitting element 118 can be reflected to avoid incidence into the light receiving element 119 if ink is in the detection portion 33, and the infrared light emitted from the light emitting element 118 can be reflected to be falling on the light receiving element 119 if ink is absent or insufficient in the detection portion 33.

As shown in FIGS. 2 and 3, a through-hole 34 is formed in the front wall 40 at a position above the detection portion 33. Further, a segment 32 formed with an air communication passage 32*a* in alignment with the through-hole 34 is provided at a rear surface of the front wall 40 for permitting an air layer in the ink chamber 36 to be communicated with the atmosphere. The air communication passage 32*a* is sealed with a film (not shown) in an unused state before installation of a new ink cartridge 30 into the cartridge installation portion 110, for example, prior to shipment. Therefore, if the ink chamber 36 is decompressed, the decompression can be maintained. Upon installing the ink cartridge 30 into the cartridge installation portion 110, a rod 124 (described later) provided at the cartridge installation portion 110 breaks the sealing film to open the air communication passage 32*a*, so that the ink chamber 36 becomes atmospheric pressure.

The air communication passage 32*a* can be communicated with or shut off from the atmosphere by a valve (not shown). Upon opening the valve, negative pressure in the ink chamber 36 becomes the atmospheric pressure. Incidentally, the air communication passage 32*a* can be positioned at a position other than the front wall 40 as long as the interior of the ink chamber 36 is communicated with the atmosphere. In particular, adhesion of ink to a circuit substrate of the optical sensor 114 can be avoided if the air communication passage 32*a* is positioned lower than the detection portion 33 or positioned at the rear wall 42. Further, the air communication passage 32*a* is not necessarily required if the ink cartridge 30 is used with maintaining negative pressure.

As shown in FIGS. 2 and 3, an ink supply portion 37 is provided at the front wall 40 at a position below the detection portion 33. More specifically, the ink supply portion 37 is positioned below an imaginary horizontal line 54 extending in the depthwise direction 53 in FIG. 3, the imaginary horizontal line 54 being positioned at a vertically intermediate height of the cartridge body 31 and passing through a center point between upper and lower ends of the front wall 40 and another center point between upper and lower ends of the rear wall 42.

Figure 4:
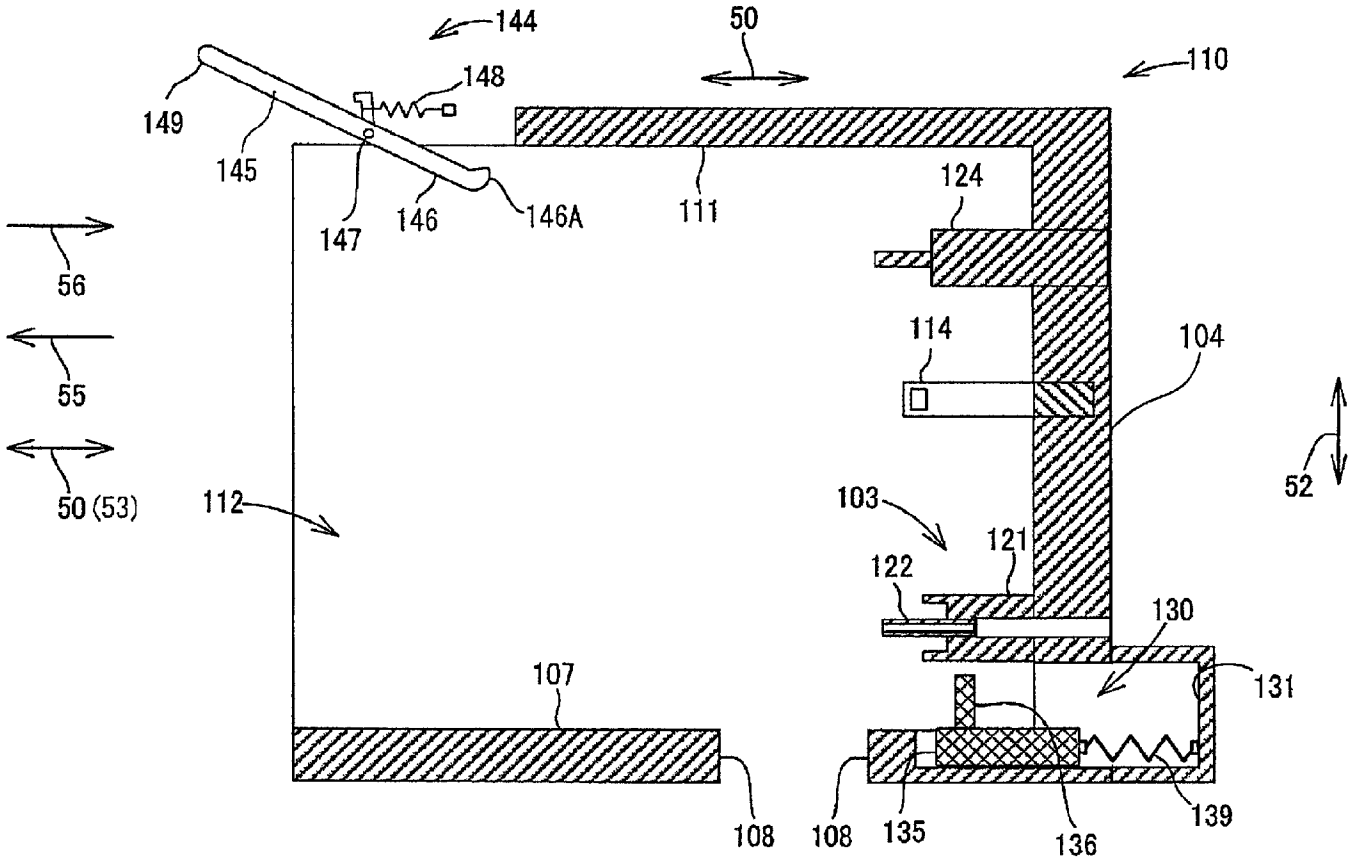
FIG. 4 is vertical cross-sectional view illustrating an internal configuration of a cartridge installation portion according to the first embodiment of the invention.

The ink supply portion 37 has a cylindrical configuration protruding from the front wall 40 frontward in the installation direction 56 (in a direction away from the ink chamber 36). An ink passage 38 extending in the installation direction 56 is formed in the ink supply portion 37. The ink passage 38 has an outer end functioning as an ink supply outlet 71 which is opened or closed by an ink supply valve (not shown). The ink supply outlet 71 is in fluid communication with the ink chamber 36 through the ink passage 38. The cartridge installation portion 110 is provided with an ink needle 122 (FIG. 4). Upon installing the ink cartridge 30 into the cartridge installation portion 110, the ink needle 122 is inserted into the ink supply outlet 71 to open the ink supply valve, whereupon ink is flowed out of the ink chamber 36 into the ink needle 122 through the ink passage 38.

Instead of the ink supply valve, a film covering the ink supply outlet 71 is available. In the latter case, upon installation of the ink cartridge 30 into the cartridge installation portion 110, the ink needle 122 breaks the film to open the ink supply outlet 71.

As shown in FIGS. 2 and 3, the protrusion 46 is provided at the lower end portion of the front wall 40, i.e., the protrusion 46 is positioned lower than the ink supply portion 37 on the front wall 40.

The protrusion 46 has a width approximately the same as that of the front wall 40 in the widthwise direction 51. The protrusion 46 protrudes from a lower end of the front wall 40 in a direction away from the rear wall 42 (frontward in the installation direction 56). The protrusion 46 has a tip end 75 positioned farther frontward than the ink supply outlet 71 in the installation direction 56. The protruding length of the protrusion 46 is altered depending on a type of the ink cartridge 30, such as ink color, ink constituent, and amount of ink to be initially stored in the ink chamber 36. The protrusion 46 corresponds to a particular interface. The protrusion 46 may be biased by a biasing member 139, 135 in a direction 55 opposite to the installation direction 56. Moreover, the protrusion 46 may protrude from an upper end of the front wall 40 in the installation direction 56.

As shown in FIG. 2, the cartridge body 31 further includes a guide portion 35 protruding upward from the top wall 39 and extending in the depthwise direction 53. A rib or projecting segment is available as the guide portion 35. Further, the guide portion 35 has a width smaller than that of the cartridge body 31.

Another guide portion 44 protrudes downward from the bottom wall 41 and extends in the depthwise direction 53. A rib or projecting segment is available as the guide portion 44. Further, the guide portion 44 has a width smaller than that of the cartridge body 31. The cartridge installation portion 110 has guide grooves 109 (FIG. 5) so as to guide the guide portions 35 and 44 therealong.

As described earlier, the printer 10 includes the ink supply device 100 configured to supply ink to the recording head 21. The ink supply device 100 has the cartridge installation portion 110 in which the ink cartridge 30 can be detachably installed. FIG. 1 shows an installed state of the ink cartridge 30 into the cartridge installation portion 110.

The cartridge installation portion 110 will be described next in detail. As shown in FIGS. 4 and 5, the cartridge installation portion 110 is defined by a casing 101 that is a hollow box shaped member formed with the opening 112 at a front side of the printer 10. An internal space of the casing 101 is defined by a top wall 111 formed with the guide grooves 109, a bottom wall 107 also formed with the guide grooves 109, a terminal end wall 104, and a pair of side walls 115, 116 extending in the installation direction 56 and connecting the top wall 111 to the bottom wall 107. The ink cartridge 30 is installed in and removed from the casing 101 through the opening 112. At this time, the guide portion 35 is inserted into one of the guide grooves 109 at the top wall 111, and the guide portion 44 is inserted into corresponding one of the guide grooves 109 at the bottom wall 107. As a result, movement of the ink cartridge 30 in the installation direction 56 and the removal direction 55 can be guided by the guide grooves 109. Four ink cartridges 30 of cyan, magenta, yellow and black are loaded into the casing 101.

As shown in FIG. 5, three plates 102 extend in the vertical direction 52 are arrayed in the widthwise direction 51 so as to partition the internal space of the casing 101 into four vertically elongated spaces. Thus, four ink cartridges 30 are respectively installed in the four spaces. These plates 102 are positioned offset from the opening 112 but are positioned adjacent to or at the terminal end wall 104 of the casing 101.

The bottom wall 107 has engagement holes 108, each positioned in each guide groove 109. In other words, respective engagement holes 108 are positioned near the plates 102. The engagement hole 108 permits the ink leaked from the ink supply portion 37 to escape to the outside of the cartridge installation portion 110, for example. To this effect, an ink tray (not shown) is disposed at a position below the engagement holes 108 in order to absorb the leaked ink by capillary force. In this embodiment, the bottom wall 107 of the cartridge installation portion 110 has four engagement holes 108, each engagement hole 108 being formed as a through-hole of the bottom wall 107 of the cartridge installation portion 110 (also see FIGS. 6 through 8). The engagement hole 108 corresponds to a locking section of the cartridge installation portion 110.

As shown in FIG. 4, a connecting portion 103 is provided at the terminal end wall 104 of the casing 101. The position of the connecting portion 103 is aligned with the ink supply portion 37 when the ink cartridge 30 is installed in the casing 101. In the first embodiment, four connecting portions 103 are provided corresponding to four ink cartridges 30 installable in the casing 101.

The connecting portion 103 includes the ink needle 122 and a holding portion 121. The ink needle 122 is tubular shaped and is formed of a resin. The ink needle 122 is connected to the ink tube 20. Each ink tube 20 connected to each ink needle 122 extends upward along an outer surface of the terminal end wall 104, and extends to the recording head 21 (See FIG. 1).

Figure 6:
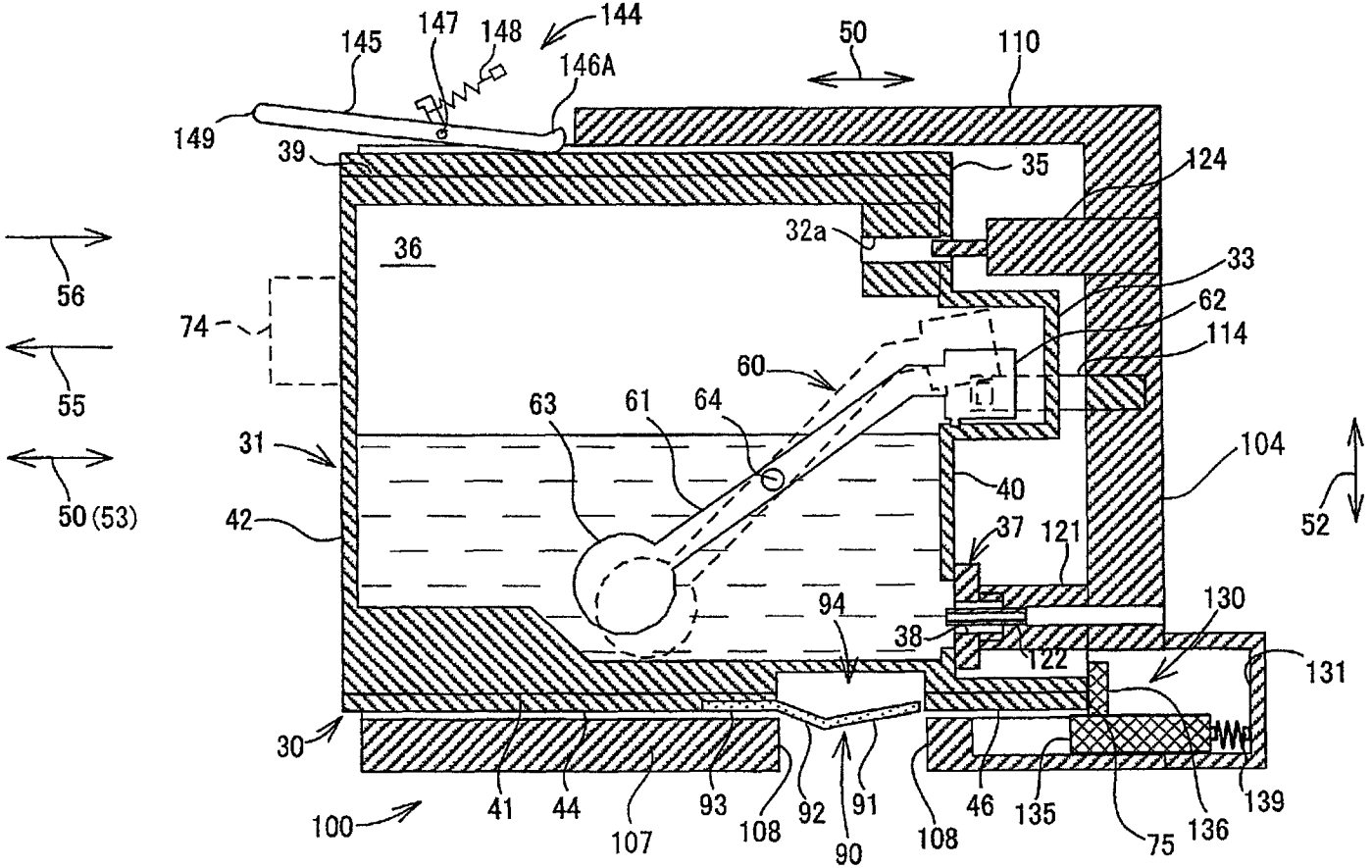
FIG. 6 is a vertical cross-sectional view illustrating the internal configurations of the ink cartridge and the cartridge installation portion according to the first embodiment, and illustrating a fully installed state of the ink cartridge into the cartridge installation portion.

The holding portion 121 has a hollow cylindrical shape, and the ink needle 122 coaxially extends in the holding portion 121. As shown in FIG. 6, upon installing the ink cartridge 30 into the cartridge installation portion 110, the ink supply portion 37 is hermetically inserted, by a predetermined depth, into an inner peripheral surface of the holding portion 121. As a result of the insertion of the ink supply portion 37 into the holding portion 121, the ink needle 122 is inserted into the ink supply outlet 71. Thus, the ink stored in the ink chamber 36 can be flowed into the ink needle 122 from the ink chamber 36.

As shown in FIG. 4, the rod 124 extends from an upper portion of the terminal end wall 104 of the casing 101 in the removal direction 55. Upon loading the ink cartridge 30 into the cartridge installation portion 110, the rod 124 is inserted in the air communication passage 32*a* as shown in FIG. 6, thereby breaking the sealing film to allow the ink chamber 36 to communicate with the atmosphere.

As shown in FIGS. 4 through 6, a sensor unit is provided at the terminal end wall 104 at a position above the connecting portion 103. The sensor unit includes the circuit substrate (not shown) and the optical sensor 114 assembled on the circuit substrate. The sensor unit contains four optical sensors 114 corresponding to four ink cartridges 30 insertable in the casing 101. Each optical sensor 114 is positioned within each of the four spaces of the casing 101 (between the neighboring plates 102 or between one of the plates 102 and one of the side walls 115, 116). These optical sensors 114 are arrayed in line in the widthwise direction 51.

Each optical sensor 114 includes the light emitting element 118 such as LED, and the light receiving element 119 such as a photo-transistor. The light emitting element 118 and the light receiving element 119 are surrounded by a U-shaped housing, and an outer shape of the optical sensor 114 is U-shaped. The light emitting element 118 is adapted to emit light in one direction from the housing. The light receiving element 119 is adapted to receive the light. The light emitting element 118 and the light receiving element 119 are facing each other with a predetermined distance in the U-shaped housing. The detection portion 33 of the ink cartridge 30 can be entered into a space between the light emitting element 118 and the light receiving element 119, such that the optical sensor 114 may or may not detect receive the predetermined amount of light through the detection portion 33.

As shown in FIG. 5, covers 105, 106 for covering the light emitting element 118 and light receiving element 119, respectively are provided at the casing 101. Four pairs of covers 105, 106 are provided for four optical sensors 114.

As shown in FIGS. 4 and 6, a chamber 130 is provided at a lower end portion of the terminal end wall 104, and a slide member 135 is movably retained in the chamber 130. In the present embodiment, four slide members 135 are positioned to correspond to four ink cartridges 30 which the casing 101 can accommodate therein. Here, a number of slide members 135 may not necessarily be limited to four. The chamber 130 is in fluid communication with the internal space of the cartridge installation portion 110. The slide member 135 has a substantially rectangular parallelepiped external shape. A rib 136 extends upward from the slide member 135 and is positioned in alignment with the protrusion 46 in the installation direction 56, so that the tip end 75 of the protrusion 46 is abuttable on the rib 136. In other words, the slide member 135 is positioned in an insertion path of the protrusion 46 of the ink cartridge 30 into the cartridge loading section 110 and contacts the tip end 75 of the protrusion 46 during the installation process of the ink cartridge 30.

A coil spring 139 is disposed in the chamber 130 for biasing the slide member 135 toward the opening 112, i.e., for biasing the ink cartridge 30 in the removal direction 55. The coil spring 139 is interposed between the slide member 135 and a terminal wall 131 defining an inner terminal end of the chamber 130. The slide member 135 is positioned at a predetermined position on a side closer to the opening 112 when the coil spring 139 has a natural length, i.e., when the slide member 135 is not applied with an external force, as shown in FIG. 4. In the process of the installation of the ink cartridge 30 into the cartridge installation portion 110, the protrusion 46 is brought into contact with the slide member 135, and the slide member 135 is pressed and slidingly moved toward the terminal wall 131 of the chamber 130 against the biasing force of the coil spring 139. Thereby, the coil spring 139 is contracted, and the slide member 135 slides to a position on another side of the chamber 130 closer to the terminal wall 131 as shown FIG. 6. Consequently, the compressed coil spring 139 biases the ink cartridge 30 in the removal direction 55 via the slide member 135. In other words, the protrusion 46 of the ink cartridge 30 is subjected to the biasing force from the slide member 135 and the coil spring 139. The slide member 135 and the coil spring 139 correspond to a biasing member.

As shown in FIG. 4, the casing 101 includes a cartridge holding mechanism 144. The holding mechanism 144 includes a lever portion 145, a support shaft 147, and a coil spring 148. The lever portion 145 serves to retain the ink cartridge 30 installed in the cartridge installation portion 110 at an installed position against the biasing force of the coil spring 139. The lever portion 145 is provided at an upper end of the opening 112 of the casing 101. In the first embodiment, four levers 145 are provided in correspondence with four ink cartridges 30 installable in the casing 101.

The lever portion 145 has a substantially arm shape. The lever portion 145 has a center portion through which the support shaft 147 extends. The support shaft 147 is supported to the casing 101. Thus, the lever portion 145 is pivotally movable about the support shaft 147 at the upper portion of the opening 112.

The lever portion 145 has one side serving as an operation portion 149 and another side serving as a pressing portion 146. The operation portion 149 extends outward from the opening 112 for user's manually pivotally moving the lever portion 145.

The pressing portion 146 extends into the casing 101. The pressing portion 146 has a tip end portion 146A. The coil spring 148 (as an example of biasing members) is interposed between the casing 101 and the lever portion 145 to bias the pressing portion 146 downward (to pivotally move the pressing portion 146 in the clockwise direction in FIG. 4). The pressing portion 146 is adapted to abut on the guide portion 35 of the ink cartridge 30 and presses the ink cartridge 30 downward during loading of the ink cartridge 30 into the cartridge installation portion 110 due to the biasing force of the coil spring 148.

As shown in FIG. 3, the bottom wall 41 of the ink cartridge 30 has a front side portion that is formed with a recess 94 whose open end is at a lower surface of the cartridge body 31. As shown in FIG. 6, the bottom wall 41 is in direct confrontation with the bottom wall 107 of the cartridge installation portion 110. The recess 94 has a width equal to that of the bottom wall 41, and the recess 94 also extends through the guide portion 44. As a modification, the width of the recess 94 can be smaller than that of the bottom wall 41.

A leaf spring 90 is provided at the bottom wall 41 at a position adjacent to the recess 94. The leaf spring 90 has a width substantially equal to or smaller than that of the recess 94, so that the leaf spring 90 can be received in the recess 94 during installation or removal process. The leaf spring 90 serves as an engagement portion in the present embodiment. The leaf spring 90 (engagement portion) engages the engagement hole 108 (corresponding to the locking member) of the cartridge installation portion 110, as will be described next.

In the first embodiment, the position of the recess 94 and the leaf spring 90 in the depthwise direction 53 is coincident with the position of the engagement hole 108 when the ink cartridge 30 is in the installed state in the cartridge installation portion 110. The position of the recess 94 and the leaf spring 90 is not limited to the above position. For example, if the cartridge installation portion 110 is formed with additional recess or opening other than the engagement hole 108, the recess 94 and leaf spring 90 can be positioned to be in coincidence with the additional recess or opening.

The leaf spring 90 has a first part 91, a second part 92 and a third part 93. These parts of the leaf spring 90 are flat shape in which lengths in the depthwise direction 53 and widthwise directions 51 are greater than a length (thickness) in the vertical direction 52. Further, these three parts 91, 92, 93 have flat surfaces. The first through third parts 91, 92, 93 are arranged in this order and integral in the depthwise direction 53, and the leaf spring 90 is made from a resilient material such as a metal.

The third part 93 is fixed to one of the guide portion 44 and the bottom wall 41 (FIG. 3 shows the third part 93 fixed to the guide portion 44). The third part 93 extends in the depthwise direction 53, i.e., horizontally.

The second part 92 has one end (at the rear wall 42 side) integrally connected to the third part 93 and another end (at the front wall 40 side) integrally connected to the first part 91. The one end is positioned higher than the other end. In other words, the second part 92 is inclined such that the other end (at the front wall 40 side) is positioned farther from a bottom surface 97 of the recess 94 than the one end (at the rear wall 42 side) from the bottom surface 97.

The first part 91 has one end (at the rear wall 42 side) integrally connected to the other end of the second part 92, and has another free end (at the front wall 40 side). Further, the one end of the first part 91 is positioned lower than the other end of the first part 91. In other words, the first part 91 is inclined such that the one end (at the rear wall 42 side) of the first part 91 is positioned farther from the bottom surface 97 of the recess 94 than the other end (at the front wall 40 side) from the bottom surface 97.

Since one end (at the rear wall 42 side) of the leaf spring 90 is fixed whereas the other end (at the front wall 40 side) of the leaf spring 90 is a free end, and since the leaf spring 90 is made from the resilient material, the leaf spring 90 is resiliently deformed in a counterclockwise direction 96 in FIG. 3 when pressed from below. In other words, the first part 91 and second part 92 are pivotally moved about a boundary 95 between the second part 92 and the third part 93, so that the first part 91 and second part 92 are received in the recess 94.

As shown in FIG. 3, a first angle $\theta_1$ is defined as an intersection angle between a broken line extending along the lower surface of the bottom wall 41 and upper or lower surface of the first part 91, and a second angle $\theta_2$ is defined as an intersection angle between the broken line and upper or lower surface of the second part 92. Here, the second angle $\theta_2$ is greater than the first angle $\theta_1$. In other words, the second part 92 is steeper than the first part 91 relative to the broken line.

Apparently, the combination of the first part 91 and the second part 92 provides a V-shape whose bent corner is positioned lower than the remaining portion. In other words, the combined shape of the first and second regions 91, 92 protrudes from the bottom wall 41 toward the bottom wall 107 of the cartridge installation portion 110. The lower surface of the first part 91 corresponds to a first guide surface and the lower surface of the second part 92 corresponds to a second guide surface.

In the above described embodiment, the engagement portion (leaf spring 90) has a flat upper and lower segmental surfaces. However, an arcuate or spherical surface is also available. Further, in the depicted embodiment, the leaf spring 90 and the recess 94 are provided at the bottom wall 41. However, these can be provided at one of the top wall 39 and the side walls 83, 84.

The cartridge body 31 of the ink cartridge 30 may have a printed marking that specifies nipping regions for user's access to the ink cartridge 30. Alternatively, an anti-slipping member is provided to the cartridge body 31, or an anti-slipping shape is partly formed at an outer perimeter of the cartridge body 31 for facilitating nipping of the cartridge body 31 by user's fingers. For example, a projection 74 shown by a broken line in FIG. 6 can be provided for a finger gripped portion. The projection 74 protrudes from the rear wall 42 in the removal direction 55. Further, the projection 74 is at a vertical position between the imaginary horizontal line 54 and the upper end of the cartridge body 31. Installation and removal of the ink cartridge 30 into and from the cartridge installation portion 110 can be easily performed by nipping the projection 74 with user's fingers.

A process of installation operation of the ink cartridge 30 into the cartridge installation portion 110 will be described with reference to FIGS. 6 through 8.

Figure 7:
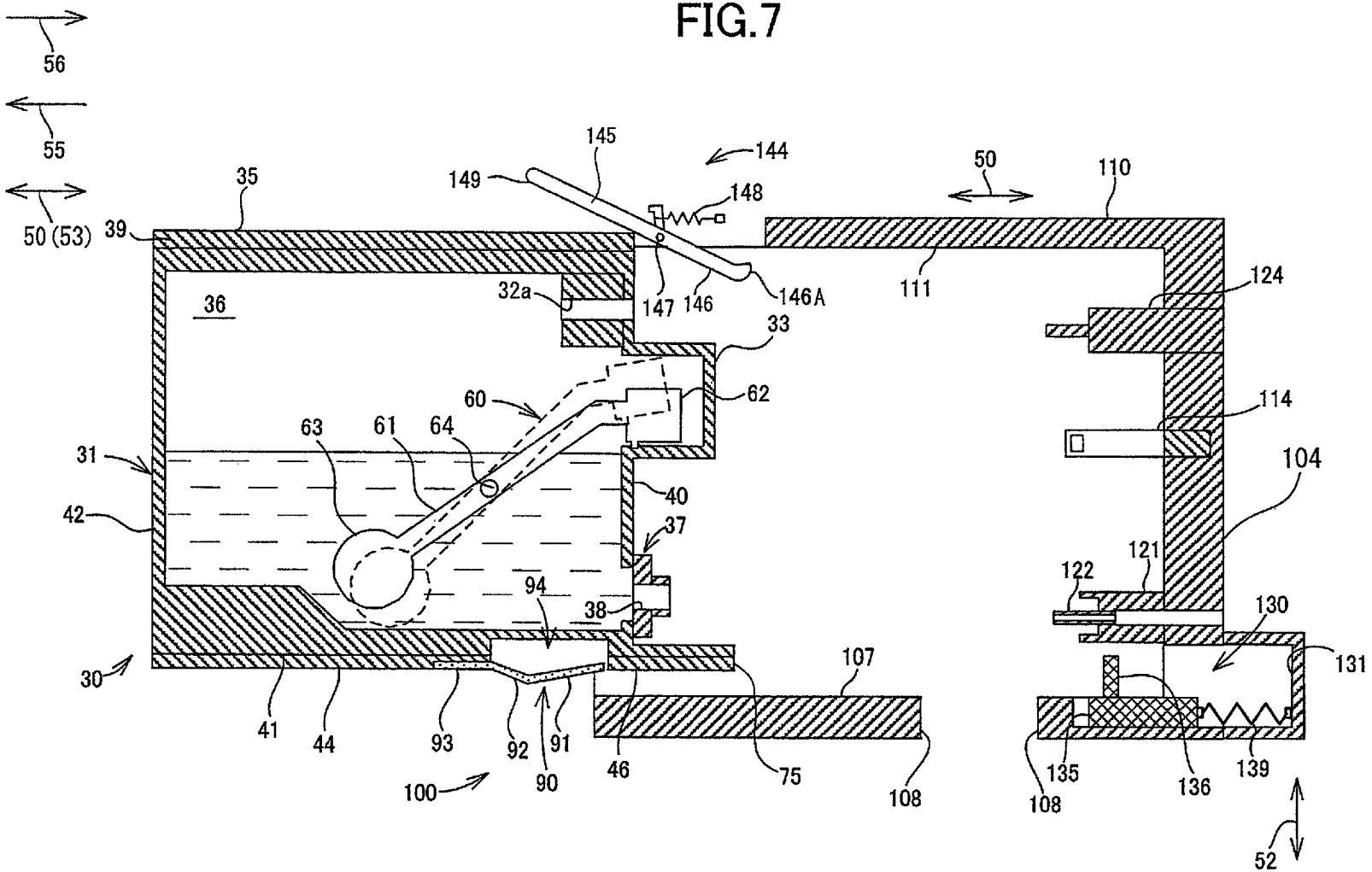
FIG. 7 is a vertical cross-sectional view illustrating the internal configurations of the ink cartridge and the cartridge loading portion according to the first embodiment, and illustrating an initial installing state of the ink cartridge into the cartridge installation portion.
Figure 8:
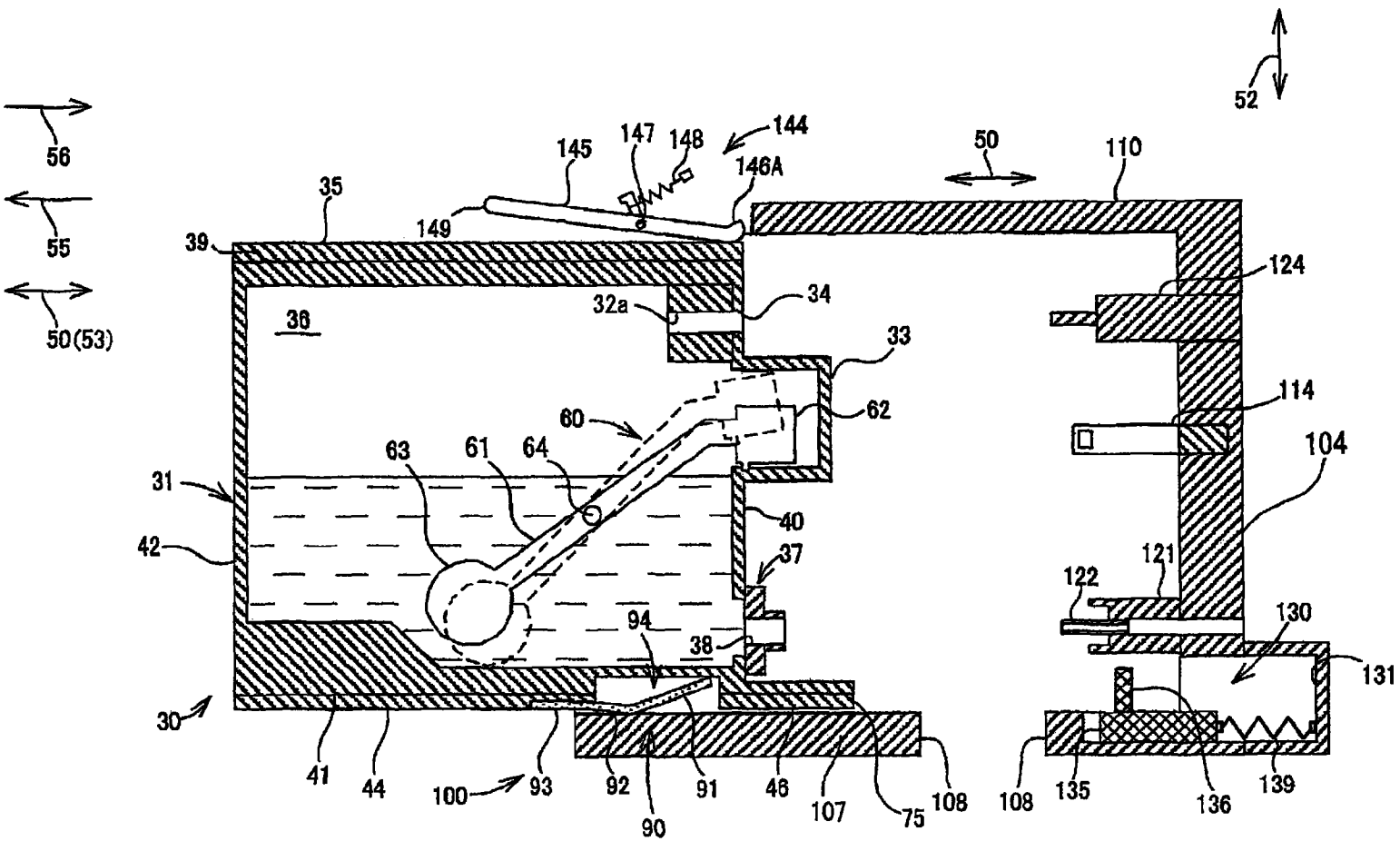
FIG. 8 is a vertical cross-sectional view illustrating the internal configurations of the ink cartridge and the cartridge installation portion according to the first embodiment, and illustrating an installing state of the ink cartridge into the cartridge installation portion after the state of FIG. 7.

As shown in FIG. 7, the ink cartridge 30 is aligned with the opening 112 after opening the cover member (not shown) that normally covers the opening 112, such that the front wall 40 is at a leading side in the installation direction 56. For the installation of the ink cartridge 30, a user holds by his fingers a portion of the cartridge body 31, the portion being close to the rear wall 42. The finger-held portion of the cartridge body 31 is not definite. However, according to an envisioned or assumed loading manner, the insertion of the ink cartridge 30 into the cartridge installation portion 110 is accompanied by user's looking down the opening 112 of the cartridge installation portion 110 provided that the printer 10 is often installed on a user's desk. Therefore, the user may often nip with his fingers a portion located in a region spanning between the vertical center portion and the upper end portion of the cartridge body 31.

In the initial stage of insertion of the ink cartridge 30 into the cartridge installation portion 110, a tip end (a leading end portion) of the guide portion 35 comes into contact with the lever portion 145. When the ink cartridge 30 is further inserted into the cartridge installation portion 110, the pressing portion 146 of the lever portion 145 rides over the guide portion 35. Thus, the lever portion 145 is pivotally moved in the counterclockwise direction in FIG. 8. Since the lever portion 145 is biased to be pivotally moved in the clockwise direction by the biasing force of the coil spring 148, the ink cartridge 30 is pushed downward by the holding mechanism 144. Consequently, the leaf spring 90 is brought into contact with an upper surface of the bottom wall 107 of the casing 101. Accordingly, as shown in FIG. 8, the first part 91 and second part 92 of the leaf spring 90 are resiliently deformed by the upper surface, so that these parts are received in the recess 94.

When the ink cartridge 30 is further inserted into the cartridge installation portion 110, the tip end 75 of the protrusion 46 (the particular interface) is brought into abutment with the slide member 135 biased toward the opening 112 by the coil spring 139. Then, the ink cartridge 30 is further inserted into the cartridge installation portion 110 against the biasing force of the coil spring 139. That is, the user is required to push the rear wall 42 of the ink cartridge 30 further frontward in the installation direction 56. The installation velocity is thus reduced (moderated) by the biasing force of the coil spring 139.

When the ink cartridge 30 is further inserted into the cartridge installation portion 110, the recess 94 of the ink cartridge 30 is brought into alignment with the engagement hole 108 of the cartridge installation portion 110 as shown in FIG. 6. Therefore, no pressing force is exerted on the leaf spring 90 from the bottom wall 107. As a result, the leaf spring 90 having been received in the recess 94 is then received in the engagement hole 108 to restore original posture shown in FIG. 3. As a result, the second part 92 comes into engagement with a boundary edge of the bottom wall 107 which constitutes the engagement hole 108.

In a state shown in FIG. 6, the ink cartridge 30 is biased in the removal direction 55 by the biasing force of the coil spring 139 via the protrusion 46. Therefore, if the user released his fingers from the ink cartridge 30, the ink cartridge 30 is pushed in the removal direction 55 by the coil spring 139. However, displacement of the ink cartridge 30 in the removal direction 55 can be restrained since the second part 92 is in contact with the boundary edge of the engagement hole 108, thereby retaining the installed state shown in FIG. 6. In other words, the engagement of the leaf spring 90 with the engagement hole 108 retains the installed state of the ink cartridge 30 as shown in FIG. 6 against the biasing force of the coil spring 139.

When the user nips the rear wall 42 of the ink cartridge 30 with his fingers and pulls out the fully installed ink cartridge 30 in the removal direction 55, the second part 92 is pushed by the boundary edge of the engagement hole 108, so that the leaf spring 90 is resiliently deformed to be pivotally moved in the direction indicated by the arrow 96 in FIG. 3. Thus, the leaf spring 90 is disengaged from the boundary edge of the engagement hole 108 and is received in the recess 94. At this time, as shown in FIG. 8, at least a part of the leaf spring 90 is positioned in the recess 94.

As a result of reception of the leaf spring 90 into the recess 94, the user can pull the ink cartridge 30 in the removal direction 55. The ink cartridge 30 is then pulled out of the cartridge installation portion 110 through the opening 112 by the user to provide a state shown in FIG. 7.

The leaf spring 90 is provided at the ink cartridge 30 for retaining the installed state of the ink cartridge 30. Therefore, no additional component or part is required in the cartridge installation portion 110 for retaining the installed state. The leaf spring 90 is attached to the bottom wall 41 of the ink cartridge 30 in this embodiment, but, can be integrally molded with the ink cartridge 30 (for example, with the bottom wall 41).

In the above-described embodiment, the holding mechanism 144 does not lock the ink cartridge 30 at the fully installed position, but presses the ink cartridge 30 downward. In other words, no locking structure is provided between the holding mechanism 144 and the ink cartridge 30. Therefore, loading and unloading of the ink cartridge 30 into and from the cartridge installation portion 110 can be performed even if the holding mechanism 144 is damaged or broken.

Further, if the biasing force of the coil spring 148 in the holding mechanism 144 is sufficiently large to move the ink cartridge 30 downward such that the bottom wall 41 is brought into contact with the bottom wall 107 of the casing 101, a resultant frictional force between the bottom wall 41 of the ink cartridge 30 and the bottom wall 107 of the casing 101 in the installation direction 56 can become greater than the biasing force of the coil spring 139 acting in the removal direction 55. As a result, the installed state of the cartridge 30 into the cartridge installation portion 110 can be retained.

Further, when the ink cartridge 30 is initially inserted into the cartridge installation portion 110, the first part 91 is pushed by the upper surface of the bottom wall 107, whereupon a frictional force is generated between the second part 92 of the leaf spring 90 and the upper surface. By selecting the resiliency of the leaf spring 90 or a frictional force of a material that is attached on the second part 92 of the leaf spring 90, the frictional force between the second part 92 of the leaf spring 90 and the upper surface of the bottom wall 107 (a frictional coefficient generated by the second region 92) can be greater than the biasing force of the coil spring 139. As a result, the ink cartridge 30 can be held at the installed position in the cartridge installation portion 110.

Further, as shown in FIG. 3, the second angle $\theta_2$ is greater than the first angle $\theta_1$. Generally, resilient deformation of the leaf spring 90 can easily occur if these angles are smaller when the leaf spring 90 is pressed by the bottom wall 107 of the cartridge installation portion 110. Therefore, the installation process of the ink cartridge 30 into the cartridge installation portion 110 attributed to the pressed deformation of the first part 91 by the bottom wall 107 can be performed with a force smaller than a force required in removal of the ink cartridge 30 from the cartridge installation portion 110 attributed to the pressed deformation of the second part 92 by the bottom wall 107.

Hereinafter, other embodiments of the present invention will be described with accompanying drawings wherein like parts and components are designated by the same reference numerals as those of the first embodiment to avoid duplicating description.

Figure 9:
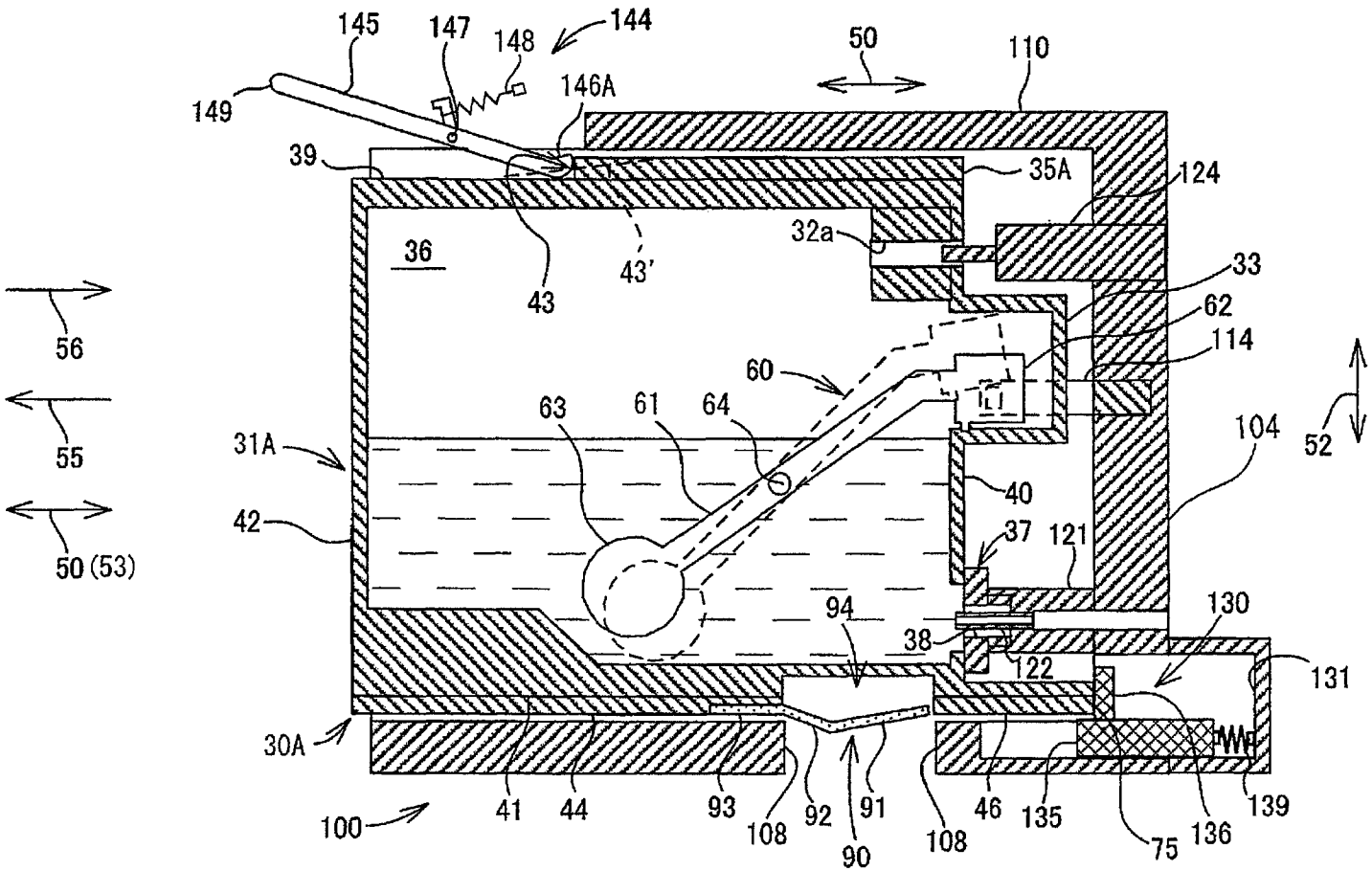
FIG. 9 is a vertical cross-sectional view illustrating an ink cartridge according to a second embodiment of the present invention, and illustrating an installed state of the ink cartridge into the cartridge installation portion.

An ink cartridge 30A according to a second embodiment of the present invention is shown in FIG. 9. A cartridge body 31A has a guide portion 35A formed with a latching portion 43 engageable with the tip end portion 146A of the holding mechanism 144. The latching portion 43 includes a vertical engaging surface having a height and a width. The pressing portion 146 of the holding mechanism 144 rides on a top surface of the guide portion 35A when the ink cartridge 30A is initially inserted into the cartridge installation portion 110. When the engaging surface of the latching portion 43 is aligned with the tip end portion 146A as a result of movement of the ink cartridge 30A in the installation direction 56, the holding mechanism 144 is pivotally moved in the clockwise direction in FIG. 9 by the biasing force of the coil spring 148, so that the tip end portion 146A is engaged with the engaging surface of the latching portion 43. Therefore, the installed position can also be locked by the holding mechanism 144. This is in contrast to the first embodiment where the holding mechanism 144 does not lock the ink cartridge 30 at the installed position, but merely presses the ink cartridge 30 downward.

More specifically, the lever portion 145 can provide a lockable pivot position as shown in FIG. 4 by the biasing force of the coil spring 148 where the tip end portion 146A is engageable with the latching portion 43, and can provide an unlocked pivot position as shown in FIG. 6 where the engagement portion 146A cannot be engaged with the latching portion 43.

If the operation portion 149 is manually pressed downward, the holding mechanism 144 is pivotally moved from the lockable position to the unlocked position. The holding mechanism 144 also functions as a locking mechanism in the second embodiment, in addition to as the cartridge holding mechanism. Instead of the vertical engaging surface of the latching portion 43, a sloped engaging surface 43' as shown by a broken line in FIG. 9 is also available. Still alternatively, the engaging surface of the latching portion 43 may be provided by a plate member extending in the installation direction 56 and the widthwise direction 51.

Figure 10:
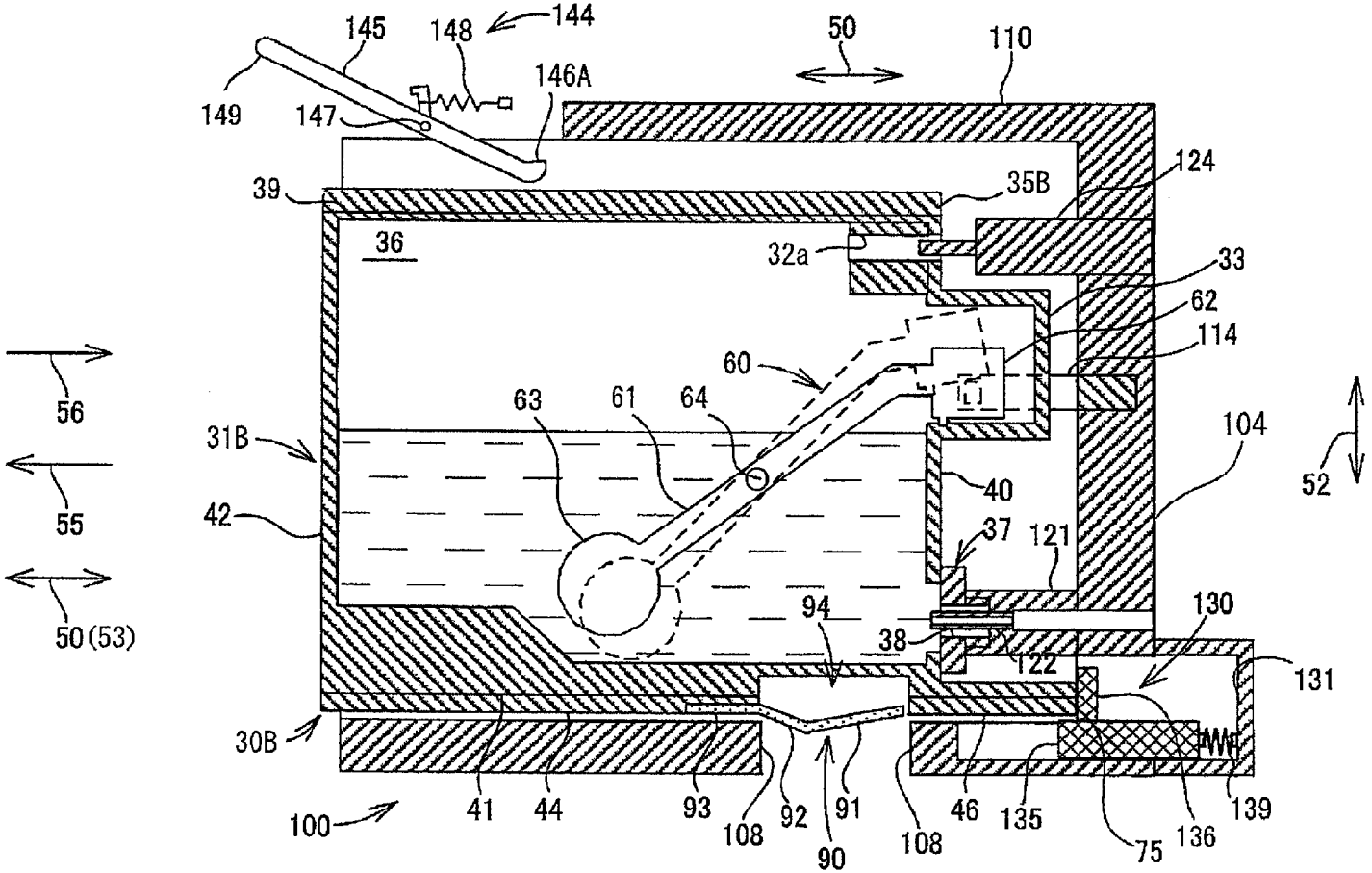
FIG. 10 is a vertical cross-sectional view illustrating an ink cartridge according to a third embodiment of the present invention, and illustrating an installed state of the ink cartridge into the cartridge installation portion.

FIG. 10 shows an ink cartridge 30B according to a third embodiment of the present invention. In the ink cartridge 30B, a cartridge body 31B has a height lower than that of the foregoing embodiments. More specifically, the lowermost portion of the lever portion 145 (i.e., a lower surface of the engagement portion 146A) at its lockable position is out of contact from the uppermost surface of the cartridge body 31B (i.e., a top surface of a guide portion 35B) when the ink cartridge 30B is installed in the cartridge installation portion 110. Therefore, the holding mechanism 144 does not act on the ink cartridge 30B at any phase during the installation and removal process of the ink cartridge 30B. Still however, the ink cartridge 30B can be remained at the installed position because of the engagement of the leaf spring 90 with the boundary edge of the engagement hole 108 against the biasing force of the biasing member 139.

Figure 11:
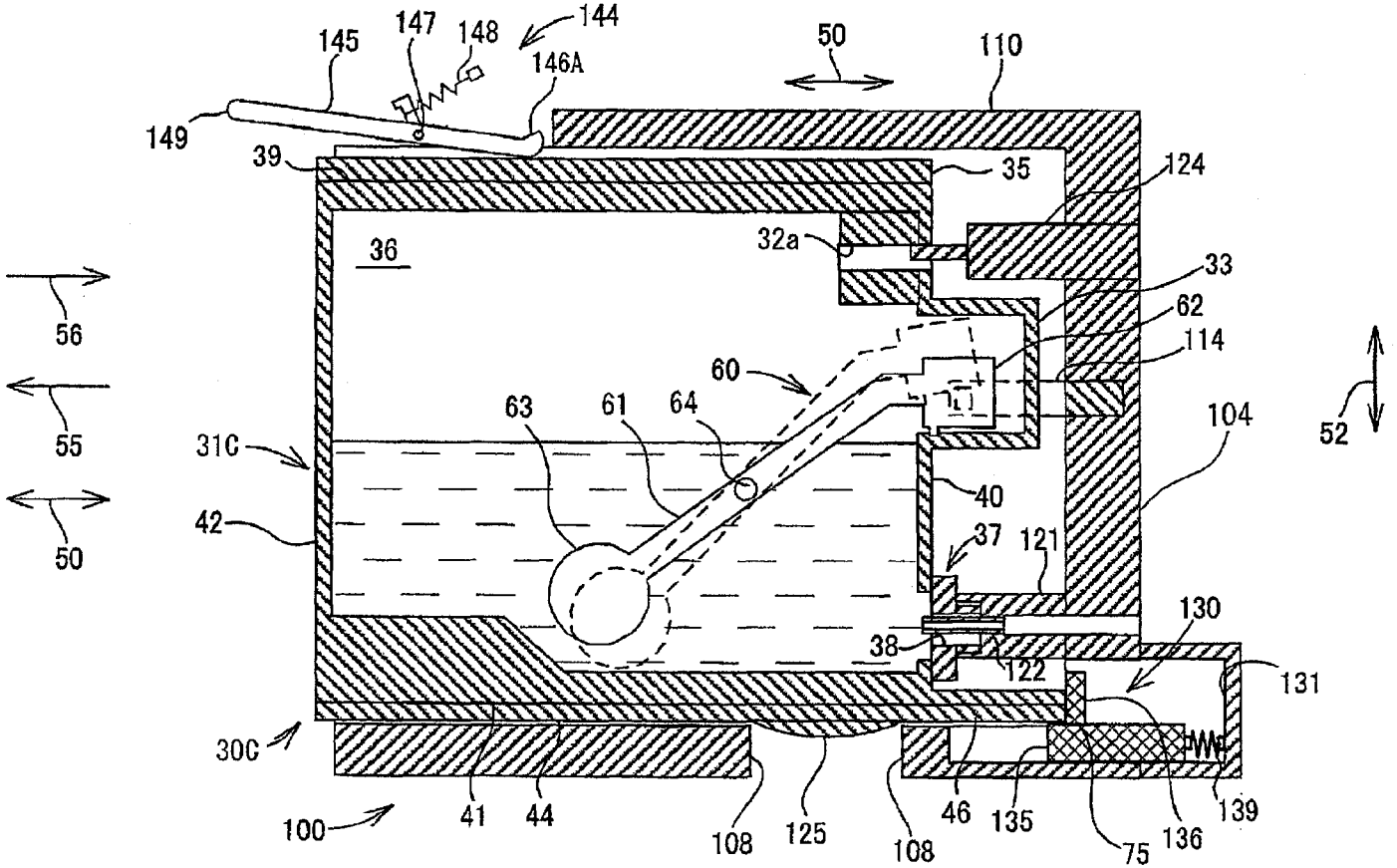
FIG. 11 is a vertical cross-sectional view illustrating an ink cartridge according to a fourth embodiment of the present invention and the cartridge installation portion, and illustrating a fully installed state of the ink cartridge into the cartridge installation portion.
Figure 12:
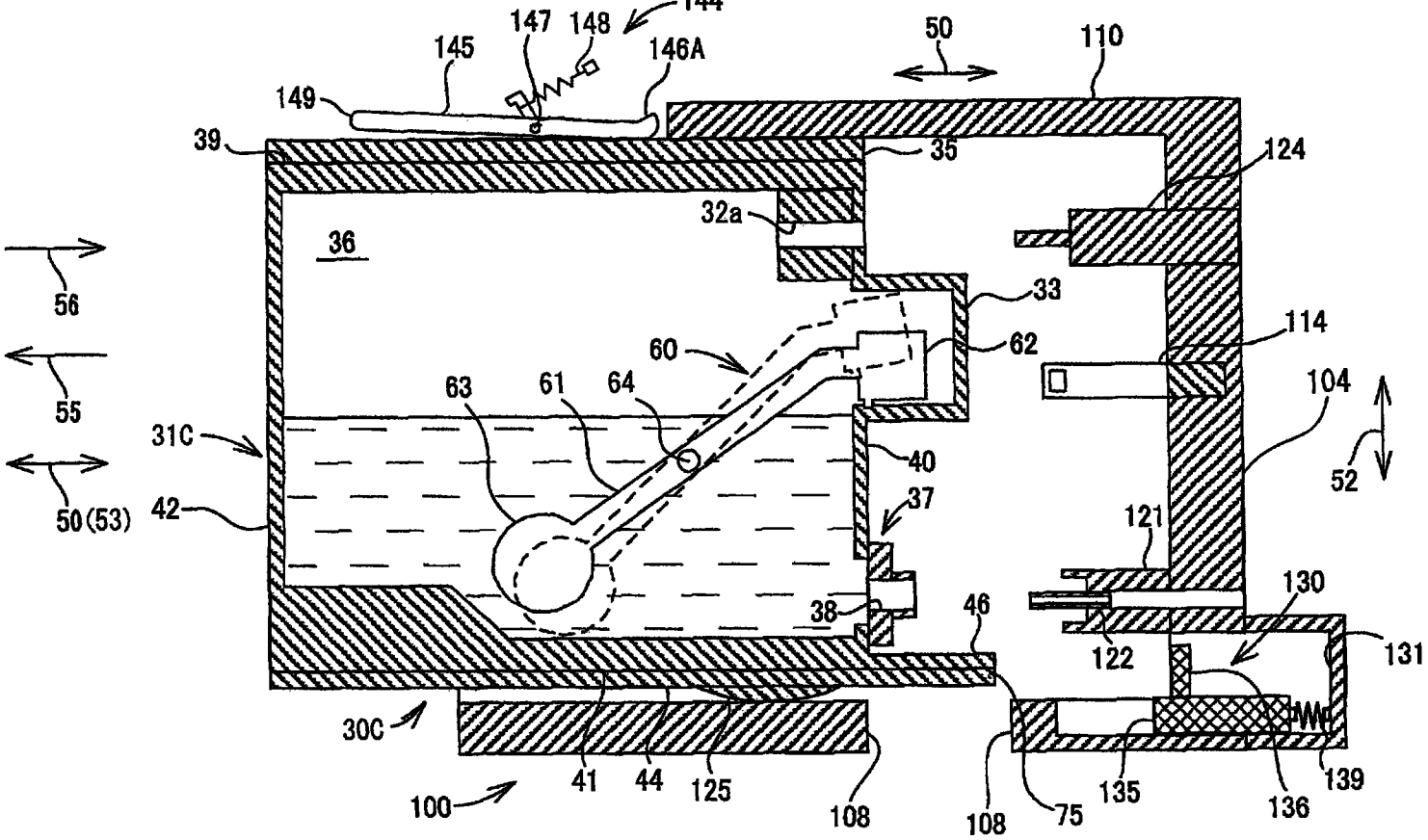
FIG. 12 is a vertical cross-sectional view illustrating the ink cartridge according to the fourth embodiment and the cartridge installation portion, and illustrating a half-installed state of the ink cartridge into the cartridge installation portion.

An ink cartridge 30C according to a fourth embodiment of the present invention will be described with reference to FIGS. 11 and 12. In the fourth embodiment, a cartridge body 31C is formed with a protrusion 125, as the engagement portion, on the lower surface of the bottom wall 41.

More specifically, the protrusion 125 has a segmental spherical surface and is disposed at the outer surface of the bottom wall 41 of the ink cartridge 30C, that is, a lower surface of the cartridge body 31C. The protrusion 125 is provided at a position in confrontation with the engagement hole 108 when the ink cartridge 30C is inserted in the cartridge installation portion 110. The ink cartridge 30C is installed into or removed from the cartridge installation portion 110, as shown in FIG. 12, while being slightly lifted up. When the ink cartridge 30C is installed in the cartridge installation portion 110, the protrusion 125 is in engagement with the engagement hole 108.

The protrusion 125 is disposed at the bottom wall 41 in the fourth embodiment, but, can be disposed at the top wall 39, or at the side walls 83, 84.

The engagement portion may be disposed at one of surfaces (outer surface of the top wall 39, the bottom wall 41, the front wall 40 or the side walls 83, 84) in confrontation with a through-hole or an opening (the engagement hole 108 in the fourth embodiment), a recess (not shown), or a projection (not shown) formed in the inner perimeter of the cartridge installation portion 110 (i.e., the top wall 111, the bottom wall 107, the pair of side walls 115, 116, or the terminal end wall 104). The surface at which the engagement portion is disposed (outer surface of the top wall 39, the bottom wall 41, the front wall 40 or the side walls 83, 84) corresponds to the first surface. The engagement portion is formed in a shape engageable with the through-hole (opening), the recess, or the projection. Still further, the engagement portion may be disposed at the first surface so as to be engageable with the neighboring plate 102 partitioning the inner space of the cartridge installation portion 110.

In the installed state of the ink cartridge 30C in the cartridge installation portion 110, the ink cartridge 30C is biased by the slide member 135 and the coil spring 139 in the removal direction 55. However, in the fourth embodiment, the ink cartridge 30C can resist the biasing force of the slide member 135 and the coil spring 139 by engagement of the protrusion 125 (or can be a through-hole, opening, protrusion, or recess) of the ink cartridge 30C with the engagement hole 108 (or a protrusion, recess, opening or projection in accordance with the shape of the corresponding engagement portion) of the cartridge installation portion 110. As a result, the ink cartridge 30C can be retained at the installed position.

If the cartridge installation portion 110 is formed with a recess or an opening other than the engagement hole 108, the recess 94 and the leaf spring 90 can be provided (instead of the protrusion 125) at a position in confrontation with the recess or the opening.

When a projection is provided on at least one of the top wall 111, the bottom wall 107, the terminal end wall 104, the pair of side walls 115, 116, and the plate 102 of the cartridge installation portion 110, the engagement portion of the ink cartridge 30C can be a recess having a shape engageable with the projection and provided on the at least one of the outer surfaces of the top wall 39, the bottom wall 41, the front wall 40 and the side walls 83, 84 of the cartridge body 31 so as to be in confrontation with the projection.

Figure 13:
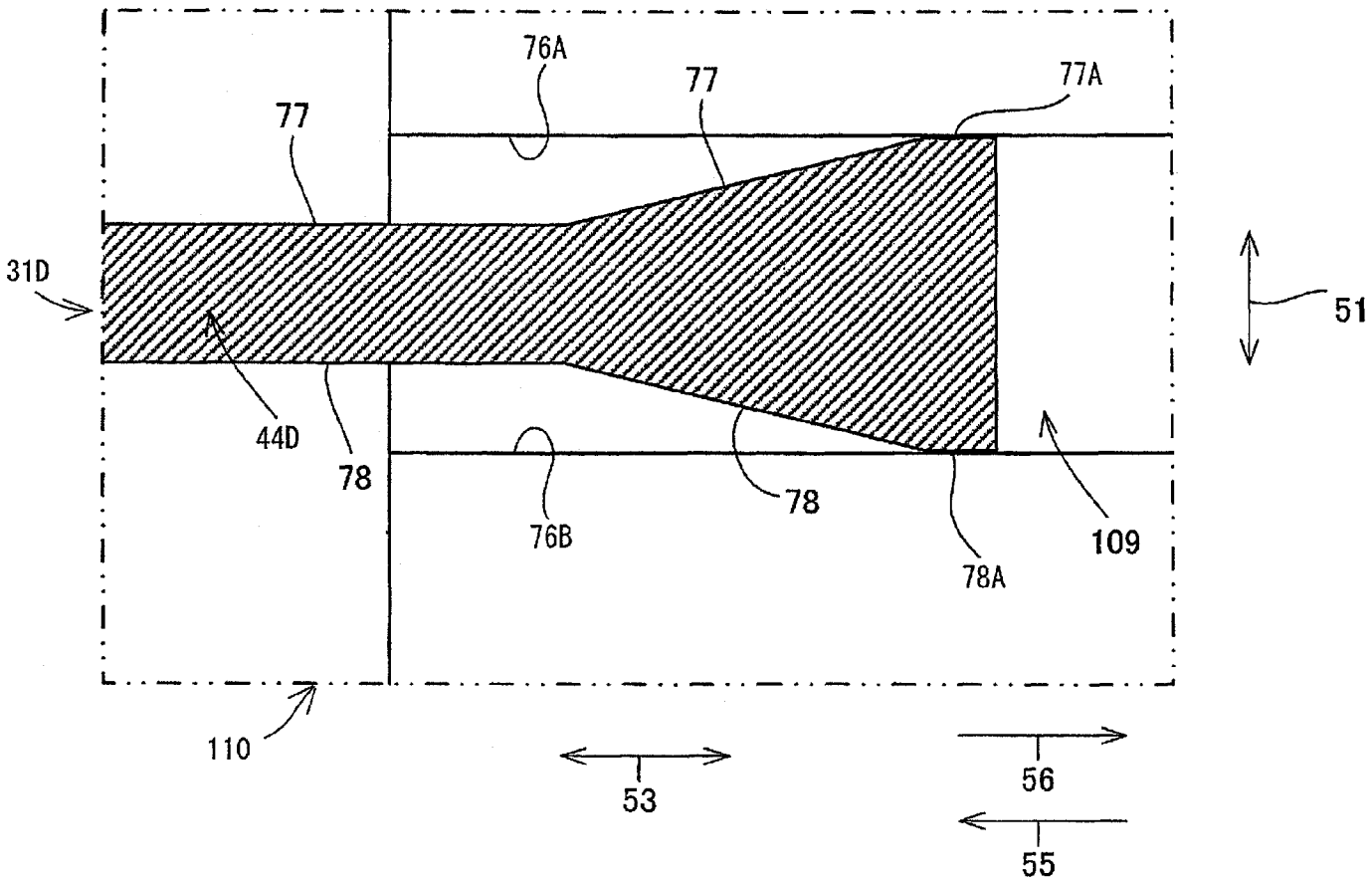
FIG. 13 is an enlarged horizontal cross-sectional view illustrating an engagement between an ink cartridge according to a fifth embodiment of the present invention and the cartridge installation portion.

An ink cartridge 30D according to a fifth embodiment of the present invention will be described with reference to FIG. 13. In the fifth embodiment, a guide portion 44D has a shape different from the guide portion 44 of the forgoing embodiments and serves as the engagement portion. The guide portion 35 remains unchanged and is also available on the ink cartridge 30D.

The guide portion 44D protrudes downward from the bottom wall 41. As shown in FIG. 13, the guide portion 44D has a pair of side surfaces 77, 78 extending in the vertical direction 52 and in the depthwise direction 53 and facing each other in the widthwise direction 51. The cartridge installation portion 110 is formed with the guide groove 109 having a pair of side walls 76A, 76B extending in the installation direction 56. The side surface 77 confronts the side wall 76A while the side surface 78 confronts the side wall 76B. The pair of side surfaces 77, 78 are positioned between the side walls 76A, 76B of the guide grooves 109 in the widthwise direction 51. That is, the guide portion 44D has a width smaller than that of the guide groove 109. The side surface 77 extends diagonally frontward in the installation direction 56 and outward in the widthwise direction 51, such that the side surface 77 gradually approaches the side wall 76A in the installation direction 56. The side surface 78 extends diagonally frontward in the installation direction 56 and outward in the widthwise direction 51, such that the side wall 76B gradually approaches the side surface 78 in the installation direction 56. In other words, the width of the guide portion 44D is gradually increased toward the front wall 40 in installation direction 56. The side surface 77 has a portion 77A adjacent to the front wall 40, and the portion 77A is in brought into contact with the side wall 76A. The side surface 78 has a portion 78A adjacent to the front wall 40, and the portion 78A is brought into contact with the side surface 76B. The portions 77A, 78A of the side surfaces 77, 78 have sufficient square measure to restrain the cartridge body 31 installed in the cartridge installation portion 110 from moving in the removal direction 55 against the biasing force biasing the cartridge body 31.

In this embodiment, the side surfaces 77, 78 have a flat plane (surface), but a step-like surface is also applicable as the side surface 77, 78.

When the ink cartridge 30D is being installed into or removed from the cartridge installation portion 110, the portions 77A, 78A of the side surfaces 77, 78 are brought into contact with the side walls 76A, 76B, respectively. As a result, a frictional force applying a load against the biasing force of the slide member 135 and the coil spring 139 is generated. Hence, the ink cartridge 30D can be retained at the installed position. The guide groove 109 that is engageable with the guide portion 44D (engagement portion) corresponds to the locking section in the fifth embodiment.

Either the guide portion 44D or the guide portion 35 can be formed as described above. Alternatively, both of the guide portion 44D and the guide portion 35 can be formed as described above. Further, the guide groove 109 can be formed on at least one of the side walls 115,116, and the plate 102 of the cartridge installation portion 110, and the guide portion 44D can be provided on at least one of the side walls 83, 84 of the cartridge body 31D.

Figure 14:
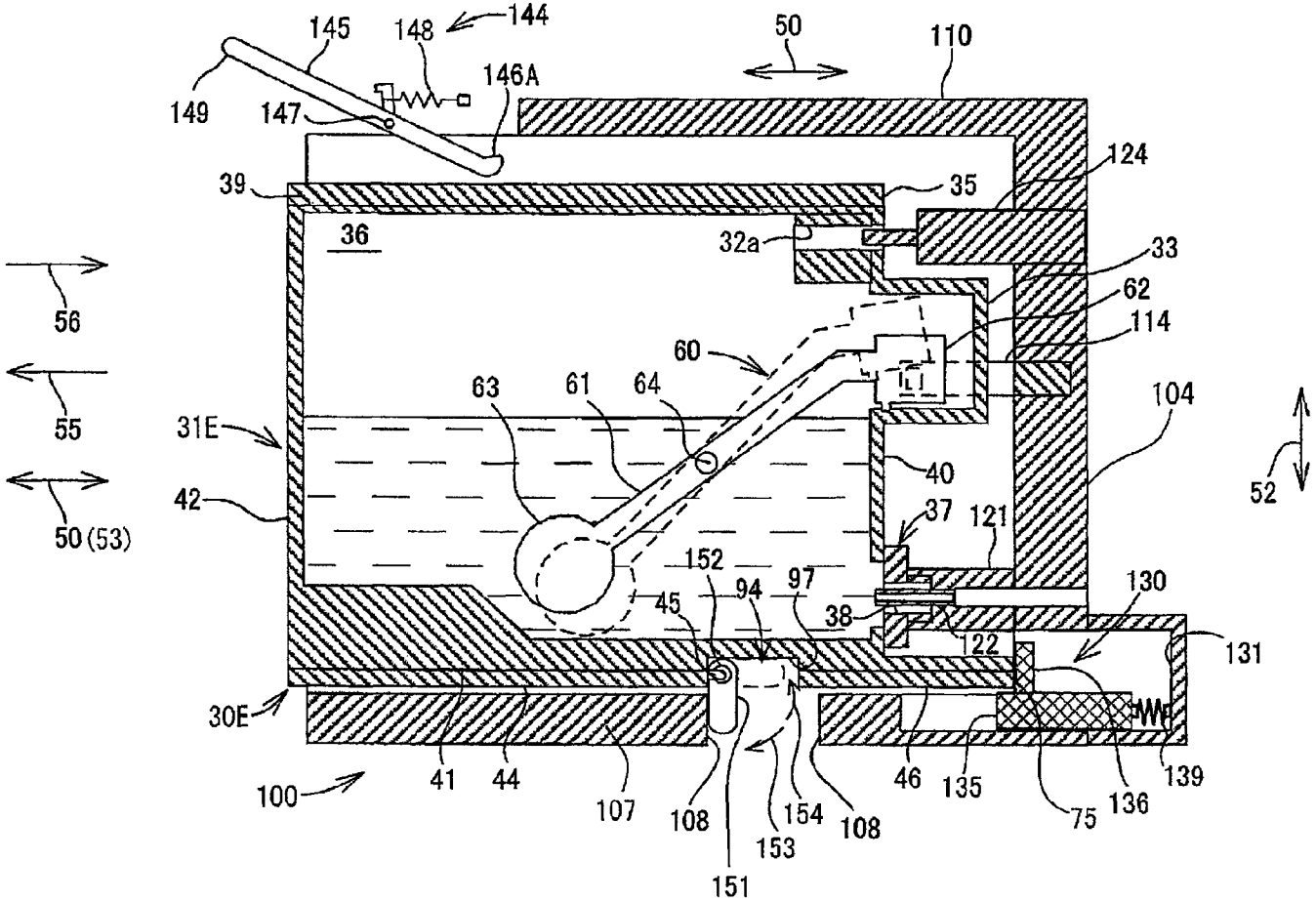
FIG. 14 is a vertical cross-sectional view illustrating an ink cartridge according to a sixth embodiment of the present invention and the cartridge installation portion, and illustrating an installed state of the ink cartridge into the cartridge installation portion.

An ink cartridge 30E according to a sixth embodiment of the present invention is shown in FIG. 14. As shown in FIG. 14, a latch lever 151 is also available as the engagement portion. The latch lever 151 can be disposed at one of the top wall 39, the bottom wall 41 and the side walls 83, 84 of the ink cartridge 30E. In FIG. 14, the latch lever 15 is disposed at the recess 94 formed in the bottom wall 41.

The latch lever 151 is formed in a plate shape. The latch lever 151 has a rear-side end portion formed with a through-hole 152. The through-hole 152 allows a shaft (not shown) to penetrate therethrough in the widthwise direction 51. Each widthwise end of the shaft is rotatably supported by a protrusions 45 protruding from a rear wall of the recess 94. The latch lever 151 is pivotally movable about the shaft in directions indicated by arrows 153, 154 in FIG. 14.

Pivotal movement of the latch lever 151 in the direction 153 brings the latch lever 151 into contact with the rear wall of the recess 94. Hence, the pivotal movement of the latch lever 151 in the direction 153 is stopped at a position indicated by a solid line in FIG. 14 (hereinafter referred to as "first position" or "lock position"). Further, pivotal movement of the latch lever 151 in the direction 154 brings the latch lever 151 into contact with a bottom wall 97 of the recess 94. Hence, the pivotal movement of the latch lever 151 in the direction 154 is stopped at a position indicated by a broken line in FIG. 14 (hereinafter referred to as "second position" or "release position"). The latch lever 151 is thus movable between the first position and the second position.

Further, the latch lever 151 is urged in the direction 153 by an urging member (not shown). A torsion spring is employed as the urging member, for example. The torsion spring includes a coil portion and two arm portions extending from each end of the coil portion. The coil portion is provided to the pivot shaft. The two arm portions are connected to the latch lever 151 so as to define an angle for biasing the latch lever 151 in the direction 153.

When the ink cartridge 30E is not installed in the cartridge installation portion 110, the latch lever 151 is in the first position. When the ink cartridge 30E is being inserted into the cartridge installation portion 110, the latch lever 151 is pushed by the bottom wall 107 of the cartridge installation portion 110, thereby changing its position from the first position to the second position. When the ink cartridge 30E is further inserted into the cartridge installation portion 110 so that the recess 94 of the ink cartridge 30 confronts the engagement hole 108 of the cartridge installation portion 110, the latch lever 151 again changes its position from the second position to the first position. As a result, the ink cartridge 30E can be retained at the installed position. The recess 94 that is engageable with the latch lever 151 (engagement portion) corresponds to the locking section in the sixth embodiment.

When the ink cartridge 30E is removed from the cartridge installation portion 110, the ink cartridge 30E is pulled out in the removal direction 55 while being slightly lifted upward by the user. That is, in the sixth embodiment, in the same manner as FIG. 10, the ink cartridge 30E has a height smaller than that of the ink cartridge 30 shown in FIG. 3.

In the sixth embodiment, the latch lever 151 is provided on the ink cartridge 30E. However, the latch lever 151 can be provided on the cartridge installation portion 110 (for example, on the engagement hole 108).

Figure 15:
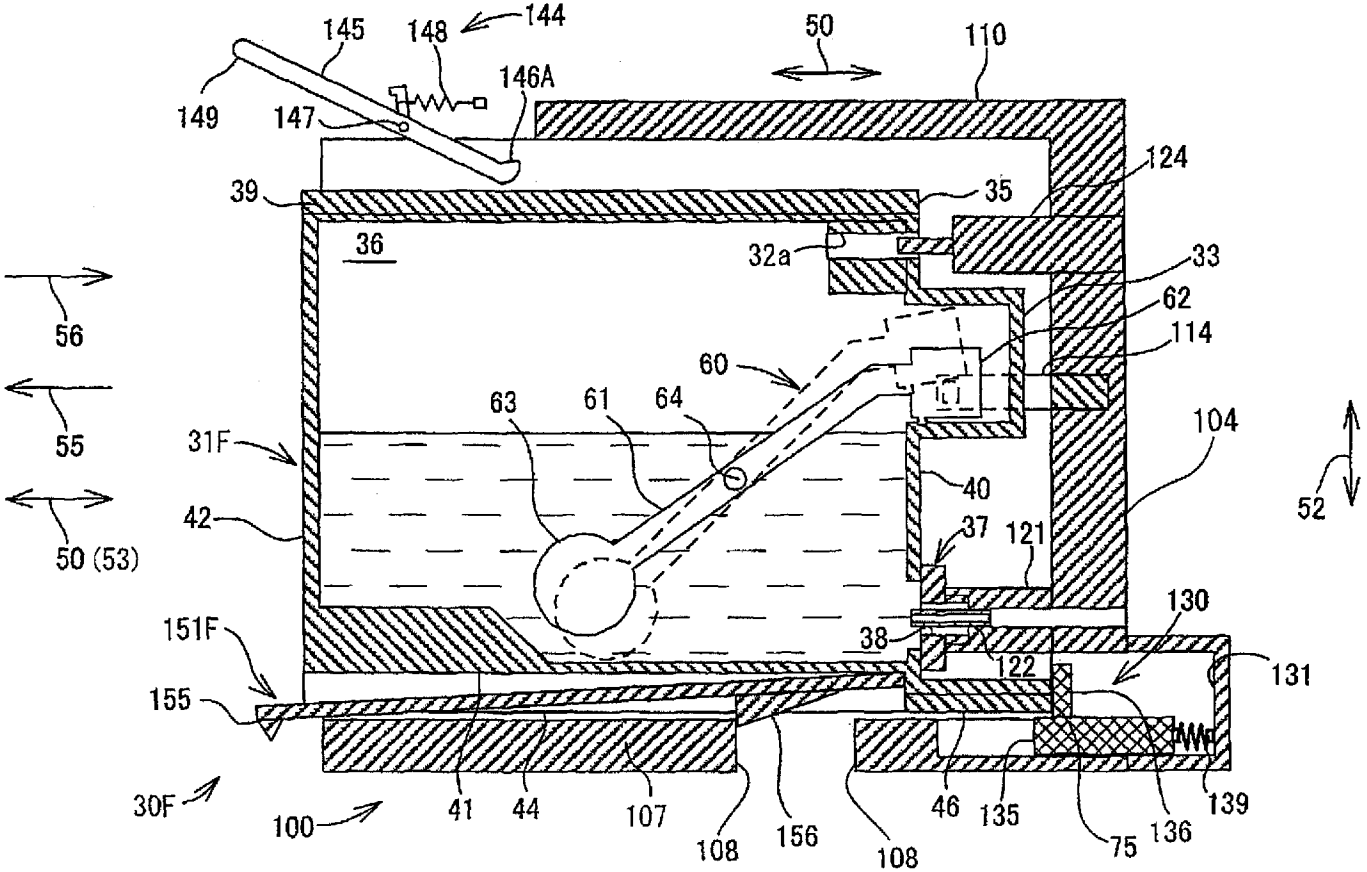
FIG. 15 is a vertical cross-sectional view illustrating an ink cartridge according to a seventh embodiment of the present invention and the cartridge installation portion, and illustrating an installed state of the ink cartridge into the cartridge installation portion.

An ink cartridge 30F according to a seventh embodiment of the present invention is shown in FIG. 15. As shown in FIG. 15, a resiliently deformable latch lever 151F extends in the depthwise direction 53 and has a base end that is resiliently supported on at least a front portion of the bottom wall 41 of the ink cartridge 30F. The latch lever 151F includes a latching knob 155 provided at a free end opposite to the base end, and a protrusion 156 functioning as a latching claw. In this embodiment, the latching claw 156 serves as the engagement portion. In the installed state of the ink cartridge 30F in the cartridge installation portion 110, the latching knob 155 protrudes from the opening 112 of the cartridge installation portion 110. Further, in the installed state of the ink cartridge 30F in the cartridge installation portion 110, one surface of the latching claw 156 faces the boundary edge of the bottom wall 107 which constitutes the engagement hole 108, and the latching claw 156 is in engagement with the engagement hole 108. The engagement hole 108 that is engageable with the latching claw 156 (engagement portion) corresponds to the locking section in the seventh embodiment.

When the ink cartridge 30F is unloaded from the cartridge installation portion 110, the user holds the top wall 39 and the latching knob 155 and pulls up the cartridge body 31F upward so as to disengage the latching claw 156 from the boundary edge of the engagement hole 108. If the user releases the latching knob 155, the latching knob 155 is resiliently moved downward to engage the latching claw 156 with the boundary edge of the engagement hole 108. In the seventh embodiment, in the same manner as FIGS. 10 and 14, the ink cartridge 30F has a height smaller than that of the ink cartridge 30 shown in FIG. 3. Hence, upward pivotal movement of the latching knob 155 enables the latching claw 156 to disengage from the boundary edge of the engagement hole 108. Further, since the slide member 135 presses the protrusion 46, the ink cartridge 30F is pushed out of the cartridge installation portion 110 in the removal direction 55. Thus, the latch lever 151F helps user's removal of the ink cartridge 30F from the cartridge installation portion 110.

The latch lever 151F is disposed at the bottom wall 41 in the seventh embodiment, but can be disposed at one of the top wall 39, the front wall 40 and the side walls 83, 84 of the ink cartridge 30F. In either case, the latch lever 151F may be engaged with a part of the cartridge installation portion 110, such as the plates 102, the guide grooves 109, and the rod 124.

Various modifications are conceivable.

<First Modification>

In the process of inserting the ink cartridge into the cartridge installation portion 110 or removing the ink cartridge from the cartridge installation portion 110, frictional contact of the engagement portion with an inner perimeter of the cartridge installation portion 110 (the top wall 111, the bottom wall 107, the front wall 40, the pair of side walls 115, 116) can generate a frictional force that is greater than the biasing force of the coil spring 139 and that applies a resistive load against the biasing force. As long as such frictional force can be generated, the engagement portion is not limited to the leaf spring 90.

For example, an elastic member, such as rubber, is available as the engagement portion. The elastic member can be provided at a portion where the engagement portion comes into contact with the inner perimeter of the cartridge installation portion 110 when the ink cartridge is installed in or removed from the cartridge installation portion 110. The elastic member is provided on at least one of outer surfaces of the top wall 39, the bottom wall 41, the front wall 40, the side walls 83, 84, the guide portion 35, and the guide portion 44 so as to be stretched therealong. Here, the outer surface is a surface in direct confrontation with the inner perimeter of the cartridge installation portion 110 when the ink cartridge is loaded into or unloaded from the cartridge installation portion 110. As described above, the portion where the engagement portion comes into contact with the inner perimeter of the cartridge installation portion 110 is at least one of the surfaces of the top wall 39, the bottom wall 41, the front wall 40 and the side walls 83, 84. When the ink cartridge is installed in the cartridge installation portion 110, the elastic member provided on the outer surface of the ink cartridge is brought into close contact with the inner perimeter of the cartridge installation portion 110, thereby generating a frictional force.

However, the elastic member can be dispensed with. Without the elastic member provided at the outer surface, the frictional force can be generated by direct contact of the outer surface of the ink cartridge with the inner perimeter of the cartridge installation portion 110.

Further, the elastic member can be provided at the outer peripheral surface of the ink supply portion 37. As shown hi FIG. 6, upon installation of the ink cartridge 30 into the cartridge installation portion 110, the ink supply portion 37 is inserted into the cylindrical holding portion 121. As a result, the elastic member provided at the outer peripheral surface of the ink supply portion 37 is brought into close contact with the inner peripheral surface of the holding portion 121, thereby generating a frictional force.

Further, the elastic member can be provided at an inner peripheral surface of the air communication passage 32*a*. As shown in FIG. 6, upon insertion of the ink cartridge 30 into the cartridge installation portion 110, the rod 124 is inserted into the air communication passage 32*a*. As a result, the elastic member provided at the inner peripheral surface of the air communication passage 32*a* is brought into close contact with the outer peripheral surface of the rod 124, thereby generating a frictional force. The elastic member is provided not at all the inner peripheral surface of the air communication passage 32*a* but at a part of the inner peripheral surface of the air communication passage 32*a* for permitting the air in the ink chamber 36 to be communicated with the atmosphere when the ink cartridge 30 is installed in the cartridge installation portion 110.

Further, in case that the air communication passage 32*a* is provided at one of the outer surfaces of the ink cartridge other than the front wall 40, the elastic member may be provided at the front wall 40. Specifically, the front wall 40 may be formed with a hole, an opening or a recess at which the elastic member is disposed. A portion of the cartridge installation portion 110 (for example, the rod 124) is engageable with the hole, an opening or a recess formed on the front wall 40.

Further, the elastic member can be provided at the pair of side walls 85, 86 of the detection portion 33 (shown in FIG. 2). In the installed state of the ink cartridge 30 in the cartridge installation portion 110, the side walls 85, 86 are in direct confrontation with the covers 105, 106 (shown in FIG. 5), respectively. Therefore, the elastic member provided at the pair of side walls 85, 86 are brought into close contact with the covers 105, 106, thereby generating a frictional force. In order not to impair the inherent function of the detection portion 33 (the function for transmitting light emitted from the optical sensor 114), the elastic member is provided at a part of the side walls 85, 86 of the detection portion 33 (a portion except for an area irradiated with the light emitted from the optical sensor 114).

Further, the leaf spring 90 of the first embodiment is applicable to the elastic member. As described while referring to FIG. 8, when the ink cartridge 30 is being inserted into the cartridge installation portion 110, the first guide part 91 of the leaf spring 90 is pressed against the bottom wall 107 of the cartridge installation portion 110 so as to be resiliently deformed. As a result of resilient deformation, the first guide part 91 is accommodated within the recess 94. At this time, the first guide part 91 is in pressure contact with the bottom wall 107, thereby generating the frictional force.

In the first modification described above, the frictional contact of the engagement portion with the inner perimeter of the cartridge installation portion 110 can generate the frictional force in the installation direction 56 that is greater than the biasing force generated by the coil spring 139. As a result, the frictional force can prevent the ink cartridge from being moved in the removal direction 55 against the biasing force of the coil spring 139.

<Second Modification>

As the engagement portion, a member having a frictional force acting upon installation of the ink cartridge into the cartridge installation portion 110 that is smaller than a frictional force acting upon unloading of the ink cartridge from the cartridge installation portion 110 is also available.

For example, as the engagement portion, a member having high-frictional properties (or an anti-slippage member) is also available. The high-frictional member includes a plurality of protrusions formed in a predetermined area of a portion where the engagement portion comes into contact with the cartridge installation portion 110 when the ink cartridge is installed into or removed from the cartridge installation portion 110.

Here, the portion where the engagement portion is brought into contact with the cartridge installation portion 110 is at least one of the outer surfaces of the top wall 39, the bottom wall 41, the front wall 40 and the side walls 83, 84, in the same manner as the first modification.

Each of the protrusions of the high-frictional member has a first slant surface and a second slant surface extending from the first slant surface. The first slant surface is oriented in the removal direction 55 and extends diagonally downward in the installation direction 56. The second slant surface is oriented in the installation direction 56 and extends diagonally downward toward the rear wall 42.

A third angle defined between the first slant surface and the outer surface is greater than a fourth angle defined between the second slant surface and the outer surface. That is, the first slant surface is steeper than the second slant surface relative to the outer surface.

Consequently, a frictional force generated by the first slant surface when the ink cartridge is removed from the cartridge installation portion 110 is greater than a frictional force generated by the second slant surface when the ink cartridge is installed into the cartridge installation portion 110. Hence, the process of inserting the ink cartridge into the cartridge installation portion 110 can be easier than the process of removing the ink cartridge from the cartridge installation portion 110.

<Third Modification>

The ink cartridge can be retained at the installed position by a pair of stoppers 126 (shown in FIG. 5) provided in the guide groove 109 on the inner surface of the bottom wall 107 of the cartridge installation portion 110. The pair of stoppers 126 protrudes inward in the widthwise direction 51 from the pair of side walls 76A, 76B (shown in FIG. 14), respectively. The pair of stoppers 126 is in alignment with each other in the installation direction 56, that is, each of the stoppers 126 is disposed at a rear end portion of the guide groove 109. Each of the stoppers 126 has a height substantially the same as that of the side walls 76A, 76B. The stopper 126 is formed of an elastically deformable material such as a rubber.

When the ink cartridge 30 is being inserted into the cartridge installation portion 110, the pair of side surfaces of the guide portion 44 (corresponding to the side surfaces 77, 78 shown in FIG. 14 of the guide portion 44D of the ink cartridge 30D) is brought into contact with the pair of stoppers 126. At this time, the user may have a click-like tactile impression in inserting the ink cartridge 30 into the cartridge installation portion 110. However, if the user further inserts the ink cartridge 30 into the cartridge installation portion 110, the pair of stoppers 126 is elastically deformed so as to be oriented outward of the guide grooves 109 in the widthwise direction 51, that is, toward the pair of side walls 76A, 76B. Thus, the guide portion 44 can move past the pair of the stoppers 126 while the guide portion 44 is in contact with the pair of stoppers 126, and the ink cartridge 30 is installed in the cartridge installation portion 110.

When the ink cartridge 30 is installed in the cartridge installation portion 110, the rear end portion of the guide portion 44 comes into contact with the pair of stoppers 126 and is tightly nipped thereby. Accordingly, the ink cartridge 30 can be retained at the installed position against the biasing force of the coil spring 139. In other words, the ink cartridge 30 can be engaged with the cartridge installation portion 110 by the stoppers 126. In the third modification, the guide portion 44 (more specifically, the rear end portion of the guide portion 44) corresponds to the first surface.

The ink cartridge 30 can be pulled out of the cartridge installation portion 110 by the user. At this time, because the guide portion 44 is in contact with the pair of stoppers 126, the user finds slight resistance in removing the ink cartridge 30 from the cartridge installation portion 110. However, if the user further pulls the ink cartridge 30 out of the cartridge installation portion 110, the pair of stoppers 126 is elastically deformed so as to be oriented outward of the guide grooves 109 in the widthwise direction 51, that is, toward the pair of side walls 76A, 76B. Therefore, the guide portion 44 can pass between the pair of the stoppers 126 while the guide portion 44 is in contact with the pair of stoppers 126, and the ink cartridge 30 is removed from the cartridge installation portion 110.

<Fourth Modification>

Figure 16:
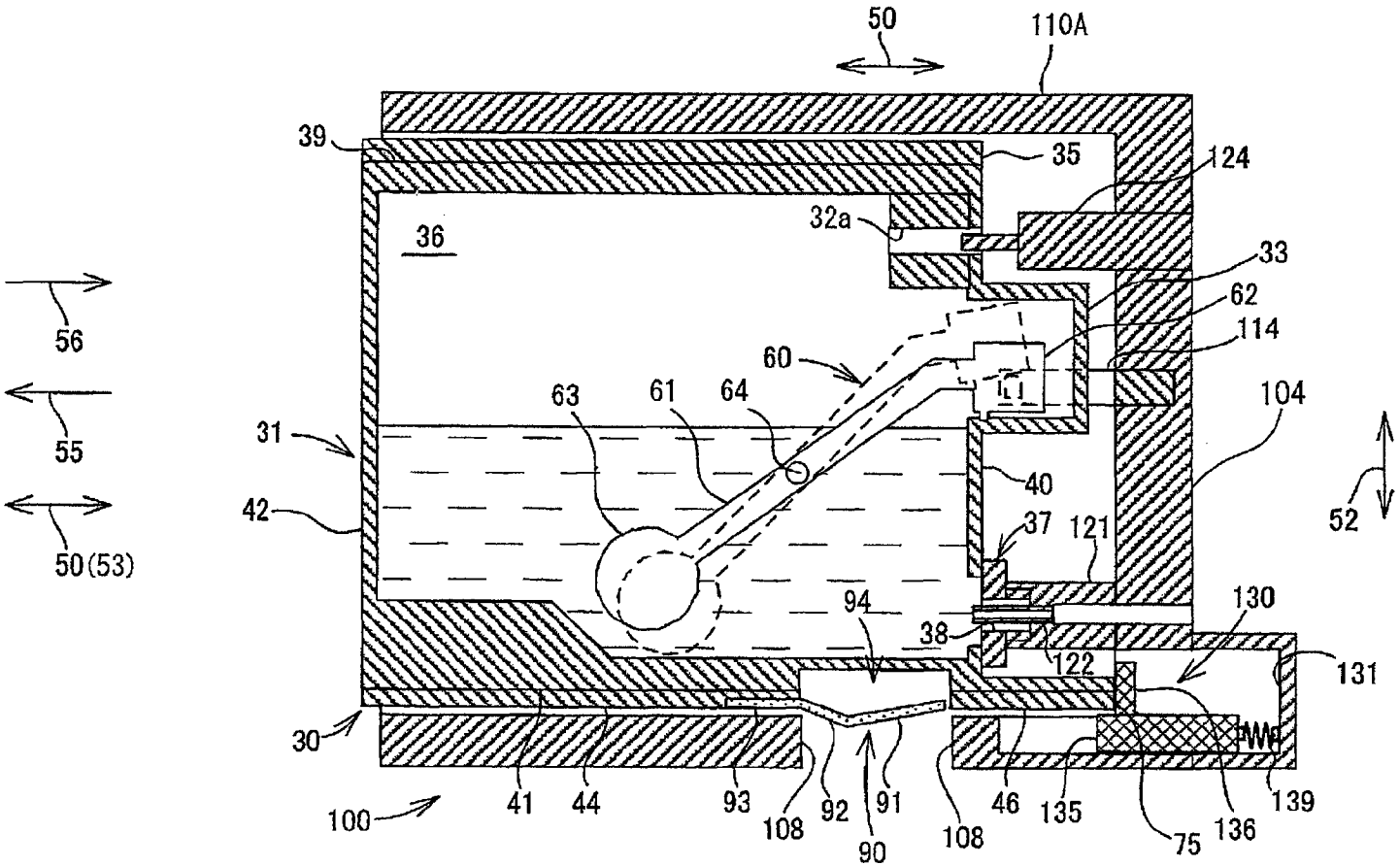
FIG. 16 is a vertical cross-sectional view illustrating the ink cartridge according to the first embodiment and a cartridge installation portion according to a fourth modification of the present invention (different from that of FIGS. 2 through 15), and illustrating an installed state of the ink cartridge into the cartridge installation portion.

As shown in FIG. 16, a cartridge installation portion 110A may not be provided with the holding mechanism 144. Still however, the ink cartridge 30 can be held at the installed position because of the provision of the leaf spring 90 (engagement portion).

While the invention has been described in detail with reference to the embodiments thereof, it would be apparent to those skilled in the art that various changes and modifications may be made therein without departing from the scope of the invention.

What is claimed is:

1. An ink cartridge configured to be installed in a cartridge installation portion of a recording apparatus in an installation direction, the ink cartridge comprising:

a body having a front side at which an ink supply portion is located for supplying ink stored in an ink chamber to an exterior of the ink chamber, and a rear side opposite the front side;

a particular interface positioned substantially adjacent to the ink supply portion at the front side, wherein the particular interface is configured to be biased by a biasing member in a specific direction; and an engagement portion protruding from a surface of the body and configured to protrude into and be engaged with a locking section of the cartridge installation portion for retaining the body in an installed state, wherein the surface of the body is formed with a recess in which the engagement portion is received during installation until the recess is aligned with the locking section, wherein the body includes an upper surface and a bottom surface opposite to the upper surface, the upper surface extending from a front surface positioned at the front side to a rear surface positioned at the rear side, and wherein the engagement portion protrudes from the bottom surface and the bottom surface is formed with the recess, and wherein the engagement portion is configured to engage the locking section for restraining the body in the installed state from moving in the specific direction against a biasing force of the biasing member, wherein the engagement portion comprises a first guide surface and a second guide surface, and wherein the first guide surface and the bottom surface define a first angle therebetween and the second guide surface and the bottom surface define a second angle therebetween greater than the first angle, and wherein the second guide surface is connected to the first guide surface and positioned closer to the rear surface than the first guide surface to the rear surface, the first guide surface having a leading end in the installation direction and a trailing end in the installation direction and connected to the second guide surface, and the second guide surface having a leading end in the installation direction and connected to the trailing end of the first guide surface and a trailing end in the installation direction, the first guide surface being slanted with respect to the installation direction such that the trailing end of the first guide surface is positioned farther from the bottom surface than the leading end of the first guide surface from the bottom surface, and the second guide surface being slanted with respect to the installation direction such that the leading end of the second guide surface is positioned farther from the bottom surface than the trailing end of the second guide surface from the bottom surface.

2. The ink cartridge according to claim 1, wherein the particular interface projects from a lower end of the front surface, and the engagement portion is positioned adjacent to the particular interface.

3. The ink cartridge according to claim 1, wherein the specific direction is a direction opposite to the installation direction.

4. The ink cartridge according to claim 1, wherein the body is further formed with an opening at the front side for drawing air from the exterior of the ink chamber into an interior of the ink chamber, and wherein the opening is configured to engage an outer peripheral surface of a rod of the cartridge installation portion.

5. The ink cartridge according to claim 1, wherein the engagement portion comprises a latch lever and an urging member, the latch lever being configured to move between a first position in which the latch lever is in engagement with the locking section and a second position in which the latch lever is disengaged from the locking section, and the urging member being configured to urge the latch lever to the first position.

6. A recording apparatus comprising:

a cartridge installation portion configured to receive the ink cartridge according to claim 1; and a pressing mechanism provided at an upper portion of the cartridge installation portion, wherein the pressing mechanism includes another biasing member and a lever portion, wherein the another biasing member is configured to bias the lever portion, and the lever portion is configured to press the upper surface of the ink cartridge downward such that the engagement portion is frictionally engaged with the locking section.

7. An ink cartridge configured to be installed in a cartridge installation portion of a recording apparatus, the ink cartridge comprising:

a body having a front side at which an ink supply portion is located for supplying ink stored in an ink chamber to an exterior of the ink chamber, and a rear side opposite the front side;

a particular interface positioned substantially adjacent to the ink supply portion at the front side, wherein the particular interface is configured to be biased by a biasing member in a specific direction; and an engagement portion configured to engage a locking section of the cartridge installation portion for retaining the body in an installed state, wherein the body includes an upper surface and a bottom surface opposite to the upper surface, the upper surface extending from a front surface positioned at the front side to a rear surface positioned at the rear side, and wherein the bottom surface is provided with the engagement portion, and the engagement portion is configured to engage the locking section for restraining the body in the installed state from moving in the specific direction against a biasing force of the biasing member, wherein the engagement portion comprises a lever portion provided at the bottom surface, and the lever portion is resiliently deformable and extends from the front side toward the rear side, wherein the lever portion comprises a latching claw configured to engage the locking section of the cartridge installation portion, and wherein the lever portion further comprises a latching knob protruding from an opening of the cartridge installation portion when the latching claw engages the locking section.

8. An ink cartridge configured to be installed in a cartridge installation portion of a recording apparatus, the ink cartridge comprising:

a body having a front side at which an ink supply portion is located for supplying ink stored in an ink chamber to an exterior of the ink chamber, and a rear side opposite the front side;

a particular interface positioned substantially adjacent to the ink supply portion at the front side, wherein the particular interface is configured to be biased by a biasing member in a specific direction; and an engagement portion configured to engage a locking section of the cartridge installation portion for retaining the body in an installed state, wherein the body includes an upper surface and a bottom surface opposite to the upper surface, the upper surface extending from a front surface positioned at the front side to a rear surface positioned at the rear side, and wherein the bottom surface is provided with the engagement portion, and the engagement portion is configured to engage the locking section for restraining the body in the installed state from moving in the specific direction against a biasing force of the biasing member, and wherein the engagement portion comprises a segmental spherical projection engageable with the locking section.

9. An ink cartridge configured to be installed in a cartridge installation portion of a recording apparatus in an installation direction, the ink cartridge comprising:

a body having a front side at which an ink supply portion is located for supplying ink stored in an ink chamber to an exterior of the ink chamber, and a rear side opposite the front side;

a particular interface positioned substantially adjacent to the ink supply portion at the front side, wherein the particular interface is configured to be biased by a biasing member in a specific direction; and an engagement portion configured to engage a locking section of the cartridge installation portion for retaining the body in an installed state, wherein the engagement portion comprises a pair of side surfaces extending along the installation direction, the pair of side surfaces defining a distance therebetween, and the distance gradually increasing toward the front side.

* * * * *